US007770423B2

(12) United States Patent
Wu

(10) Patent No.: US 7,770,423 B2
(45) Date of Patent: Aug. 10, 2010

(54) ELECTRO-MECHANICAL LOCK STRUCTURE

(75) Inventor: Wen-Pin Wu, Gangshan Town (TW)

(73) Assignee: Taiwan Fu Hsing Industrial Co., Ltd, Kaohslung County (TW)

( * ) Notice: Subject to any disclaimer, the term of this patent is extended or adjusted under 35 U.S.C. 154(b) by 265 days.

(21) Appl. No.: 12/076,245

(22) Filed: Mar. 14, 2008

(65) Prior Publication Data

US 2009/0229328 A1 Sep. 17, 2009

(51) Int. Cl.
*E05B 47/00* (2006.01)

(52) U.S. Cl. ..... 70/218; 70/223; 70/278.7; 70/279.1; 70/280; 70/472; 292/142; 292/144; 292/DIG. 27

(58) Field of Classification Search ..... 70/277, 70/280–282, 223, 189, 190, 149, 472, 278.7, 70/279.1, 422, 278.2, 278.3, 257, 188, 218, 70/222, 224; 292/142, 144, DIG. 27; 192/54.5; 464/161
See application file for complete search history.

(56) References Cited

U.S. PATENT DOCUMENTS 3,922,896 A * 12/1975 Kagoura ..... 70/223
4,022,308 A * 5/1977 Hurst ..... 192/21
4,519,487 A * 5/1985 Florin ..... 192/36
4,534,194 A * 8/1985 Aydin ..... 70/278.2
4,645,050 A * 2/1987 Ingenhoven ..... 192/36
4,980,591 A * 12/1990 Takanashi et al. ..... 310/83
5,161,431 A * 11/1992 Watanabe ..... 74/606 R
5,178,026 A * 1/1993 Matsumoto ..... 74/411
5,259,261 A * 11/1993 Michel ..... 74/425
5,404,975 A * 4/1995 Michel ..... 192/223.1
5,857,365 A * 1/1999 Armstrong ..... 70/279.1
6,032,991 A * 3/2000 Yeh ..... 292/336.3
6,053,293 A * 4/2000 Sato et al. ..... 192/35
6,333,574 B1 * 12/2001 Clark et al. ..... 310/75 R
6,591,643 B1 * 7/2003 Cannella et al. ..... 70/277
6,758,070 B2 * 7/2004 Yu et al. ..... 70/107
6,807,834 B2 * 10/2004 Tsai ..... 70/472
6,845,642 B2 * 1/2005 Imedio Ocana ..... 70/277
6,918,276 B2 * 7/2005 Van Parys ..... 70/257
7,096,697 B2 * 8/2006 Keightly ..... 70/279.1
7,516,633 B1 * 4/2009 Chang ..... 70/472
7,543,469 B1 * 6/2009 Tseng et al. ..... 70/472
2003/0121301 A1 * 7/2003 Warmack ..... 70/257

(Continued)

FOREIGN PATENT DOCUMENTS

TW 479725 3/2002

*Primary Examiner*—Lloyd A Gall

(57) ABSTRACT

An electro-mechanical lock structure comprises a casing, an electric control mechanism and a manual control member. The casing has a base and an accommodating space. The electric control mechanism is disposed within the accommodating space of the casing comprising a clutch gear, a movable assembly, a rotation member and a motor able to drive the clutch gear. The clutch gear has a first side facing the rotation member, a second side opposite to the first side and at least one pushing block disposed at the first side. The movable assembly contacts against the second side of the clutch gear. The rotation member has at least one protrusion that corresponds to the pushing block and able to be pushed to move by the pushing block. The manual control member has a knob and a spindle coupled to the knob, the spindle penetrates the base of the casing and one end of the spindle is coupled to the rotation member of the electric control mechanism.

10 Claims, 25 Drawing Sheets

U.S. PATENT DOCUMENTS

2006/0131121 A1* 6/2006 Simm et al. ..... 192/54.5
2008/0121001 A1* 5/2008 Huang et al. ..... 70/91
2009/0211320 A1* 8/2009 Wu ..... 70/277

* cited by examiner

ELECTRO-MECHANICAL LOCK STRUCTURE

FIELD OF THE INVENTION

The present invention is generally relating to a lock device, more particularly to an electro-mechanical lock structure able to perform locking/unlocking operations with electric and manual control manners.

BACKGROUND OF THE INVENTION

In general, the electro-mechanical lock structure mostly employs clutch mechanism for coupling or isolating the power of the electric and manual control to carry out locking and unlocking functions by electric and manual controls simultaneously, such as disclosed in R.O.C. Patent No. 479,725 entitled "electric lock". However, the electric lock structure is poorly designed that operating unsmooth or mutual interference sometimes happens during electric and manual control operations causing great inconvenience for users.

SUMMARY OF THE INVENTION

The primary object of this invention is to provide an electro-mechanical lock structure which comprises a casing, an electric control mechanism and a manual control member. The casing has a base and an accommodating space. The electric control mechanism disposed within the accommodating space of the casing comprises a clutch gear, a movable assembly, a rotation member and a motor able to drive the clutch gear. Where the clutch gear has a first side facing the rotation member, a second side opposite to the first side and at least one pushing block disposed at the first side, the movable assembly contacts against the second side of the clutch gear, the rotation member has at least one protrusion that corresponds to the pushing block and able to be pushed to move by the pushing block. The manual control member has a knob and a spindle coupled to the knob, the spindle penetrates the base of the casing and one end of the spindle is coupled to the rotation member of the electric control mechanism. Because of the connection having excellent coordination among the clutch gear, the rotation member and the movable assembly in accordance with this invention, operating smooth for electric control and manual control may be widely enhanced.

DETAILED DESCRIPTION OF THE INVENTION

Figure 1:
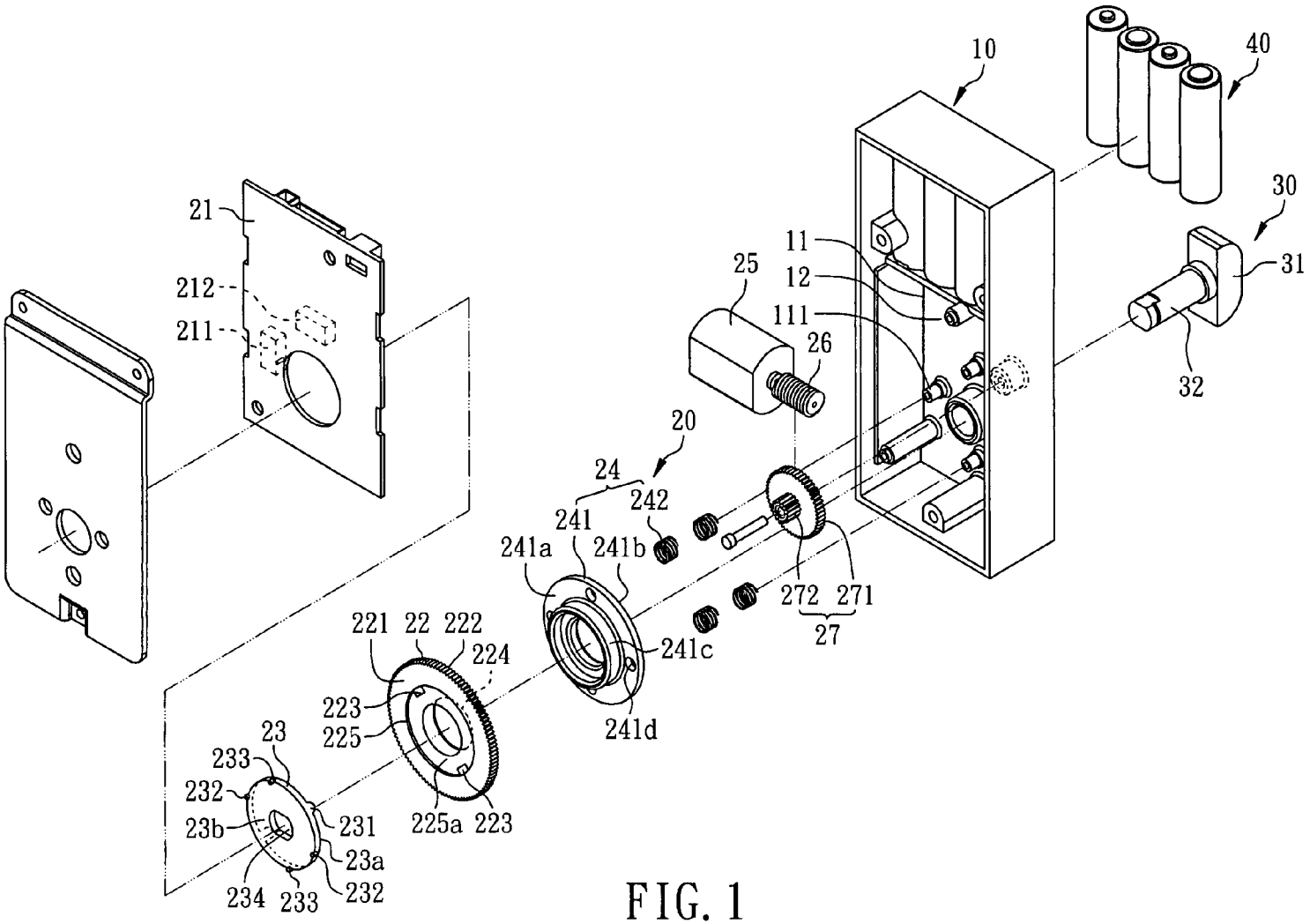
FIG. 1 is a perspective exploded view of an electro-mechanical lock structure in accordance with the first preferred embodiment of this invention.
Figure 2:
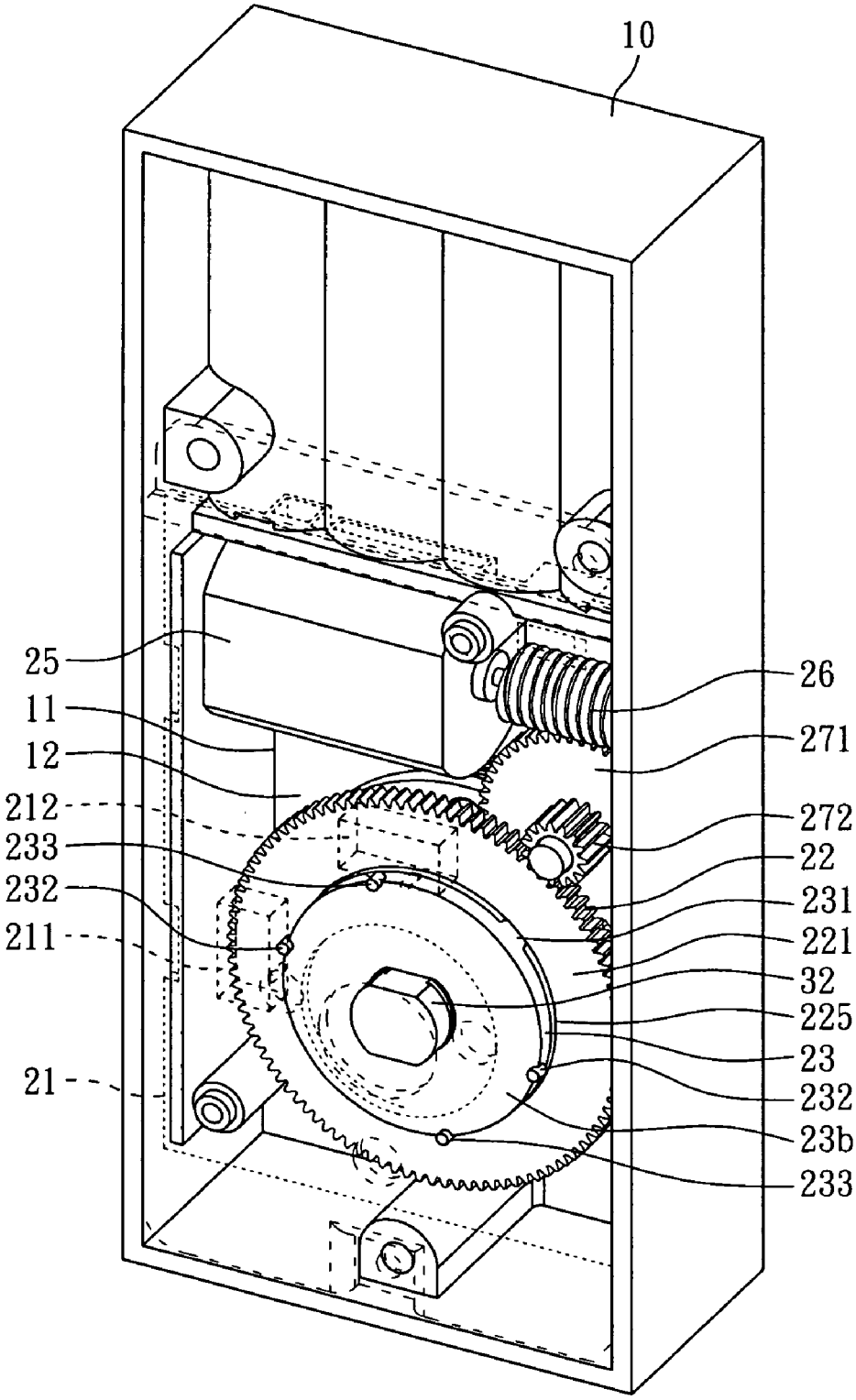
FIG. 2 is a perspective assembly view of the electro-mechanical lock structure in accordance with the first preferred embodiment of this invention.

With reference to FIG. 1 and FIG. 2, an electro-mechanical lock structure in accordance with the first embodiment of this invention comprises a casing 10, an electric control mechanism 20, a manual control member 30 and a battery set 40. The casing 10 has a base 11 and an accommodating space 12. The electric control mechanism 20 disposed within the accommodating space 12 of the casing 10 comprises a circuit board 21, a first control switch 211 and a second control switch 212 which are disposed on the circuit board 21, a clutch gear 22, a rotation member 23 corresponding to the first control switch 211, a movable assembly 24, a motor 25 able to drive the clutch gear 22, a worm gear 26 disposed on the motor 25 and a double-layer gear 27. In this embodiment, a difference of disposition angle between the first control switch 211 and the second control switch 212 is 90 degree. The clutch gear 22 has a first side 221 facing the rotation member 23, a second side 222 opposite to the first side 221, at least one pushing block 223 disposed at the first side 221 and a projecting portion 224 in circular shape protruding from the second side 222. In this embodiment, the first side 221 of the clutch gear 22 has a cavity 225 formed thereon, the pushing block 223 is disposed within the cavity 225, and the cavity 225 has a bottom surface 225*a*. Preferably, the pushing block 223 protrudes from the bottom surface 225*a* of the cavity 225. The rotation member 23 has a first surface 23*a* facing the clutch gear 22, a second surface 23*b* opposite to the first surface 23*a*, at least one protrusion 231 protruding from the first surface 23*a*, at least one first projection 232 protruding from the second surface 23*b*, at least one second projection 232 protruding from the second surface 23*b* and a central axis hole 234. The protrusion 231 corresponds to the pushing block 223 of the clutch gear 22 and able to be pushed to move by the pushing block 223 in this embodiment. Besides, the first projection 232 corresponds to first control switch 211, the second projection 233 corresponds to the second control switch 212, wherein the first projection 232 and the second projection 233 may rotate either counterclockwise to respectively actuate the first control switch 211 or clockwise to respectively actuate the second control switch 212. With reference again to FIG. 1 and FIG. 2, in this embodiment, the rotation member 23 has a pair of first projections 232 and a pair of second projections 233, wherein each of the first projections 232 may correspond to the first control switch 211 and each of the second projections 233 may correspond to the second control switch 212. Therefore, the rotation member 23 is capable of rotating either clockwise or counterclockwise as to actuate the first control switch 211 or the second control switch 212 with the first projection 232 or the second projection 233.

Figure 3:
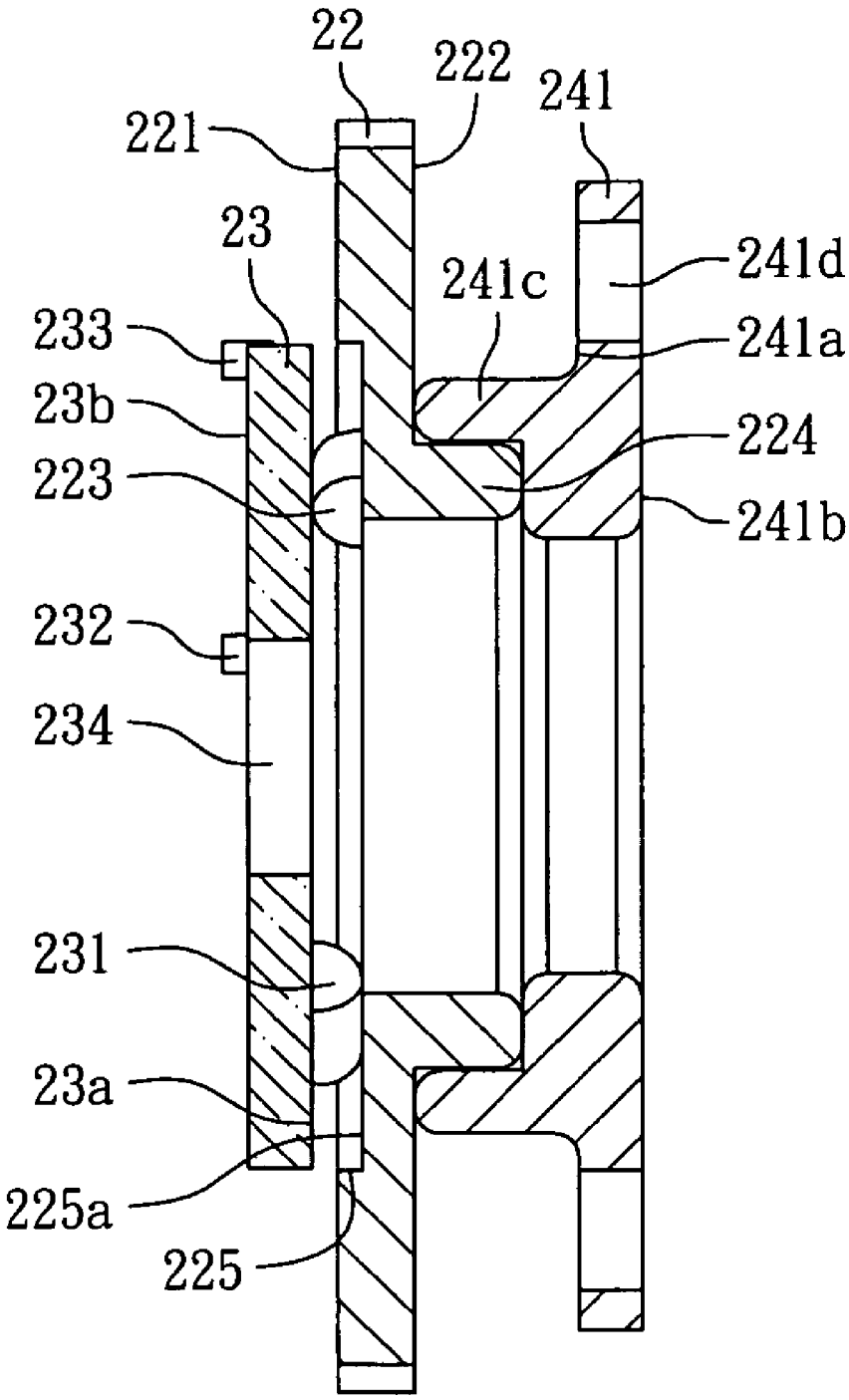
FIG. 3 is an assembly view of rotation member, clutch gear and movable plate in accordance with the first preferred embodiment of this invention.
Figure 4:
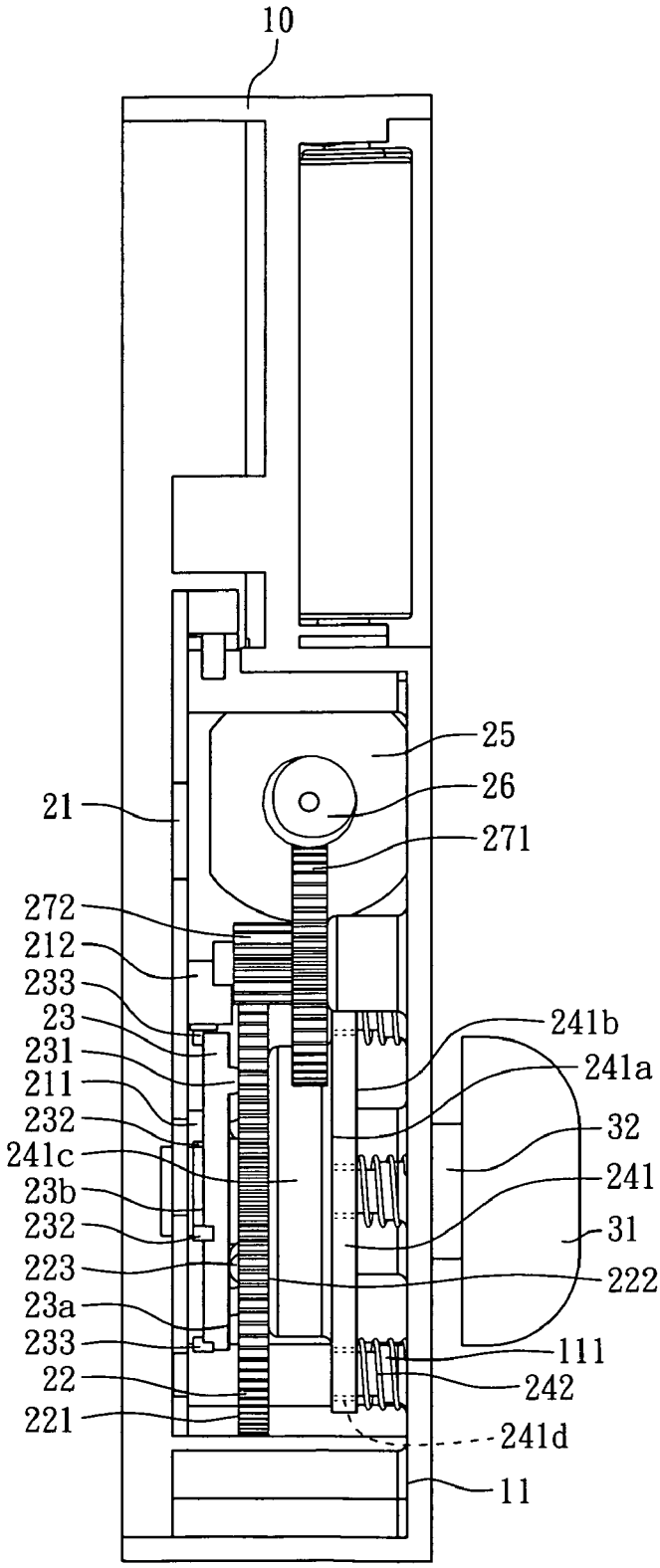
FIG. 4 is a cutaway view of a portion of the electro-mechanical lock structure in accordance with the first preferred embodiment of this invention.

With reference again to FIG. 1 and FIG. 2, the movable assembly 24 which contacts against the second side 222 of the clutch gear 22 comprises a movable plate 241 and an elastic member 242. The movable plate 241 has a first sidepiece 241*a* and a second sidepiece 241*b* opposite to the first sidepiece 241*a* and a tube portion 241*c* protruding from the first sidepiece 241*a*. With reference to FIG. 3 and FIG. 4, the first sidepiece 241*a* of the movable plate 241 contacts against the second side 222 of the clutch gear 22 in this embodiment and preferably the projecting portion 224 of the clutch gear 22 may be inserted into the tube portion 241*c* of the movable plate 241. The elastic member 242 contacts against the second sidepiece 241*b* of the movable plate 241 and preferably the base 11 of the casing 10 has at least one positioning pillar 111 formed thereon and the elastic member 242 is capable of disposing on the positioning pillar 111, and one end of the elastic member 242 contacts against the base 11. Besides, the movable plate 241 has at least one through hole 241*d* in this embodiment, the elastic member 242 corresponds to the through hole 241*d* and one end of the positioning pillar 111 is inserted into the through hole 241*d* of the movable plate 241. With reference again to FIG. 1 and FIG. 2, the motor 25 is electrically connected to the circuit board 21, the double-layer gear 27 is pivotally disposed on the base 11 having a lower layer gear 271 and an upper layer gear 272 formed on the lower layer gear 271. The lower layer gear 271 engages with the worm gear 26 and the upper layer gear 272 engages with the clutch gear 22. The manual control member 30 has a knob 31 and a spindle 32 coupled to the knob 31, the spindle 32 penetrates the base 11 of the casing 10 and one end of which is coupled to the rotation member 23 of the electric control mechanism 20 and preferably inserted into the central axis hole 234 of the rotation member 23. The battery set 40 is disposed within the accommodating space 12 of the casing 10 and electrically connected to the circuit board 21.

Figure 5A:
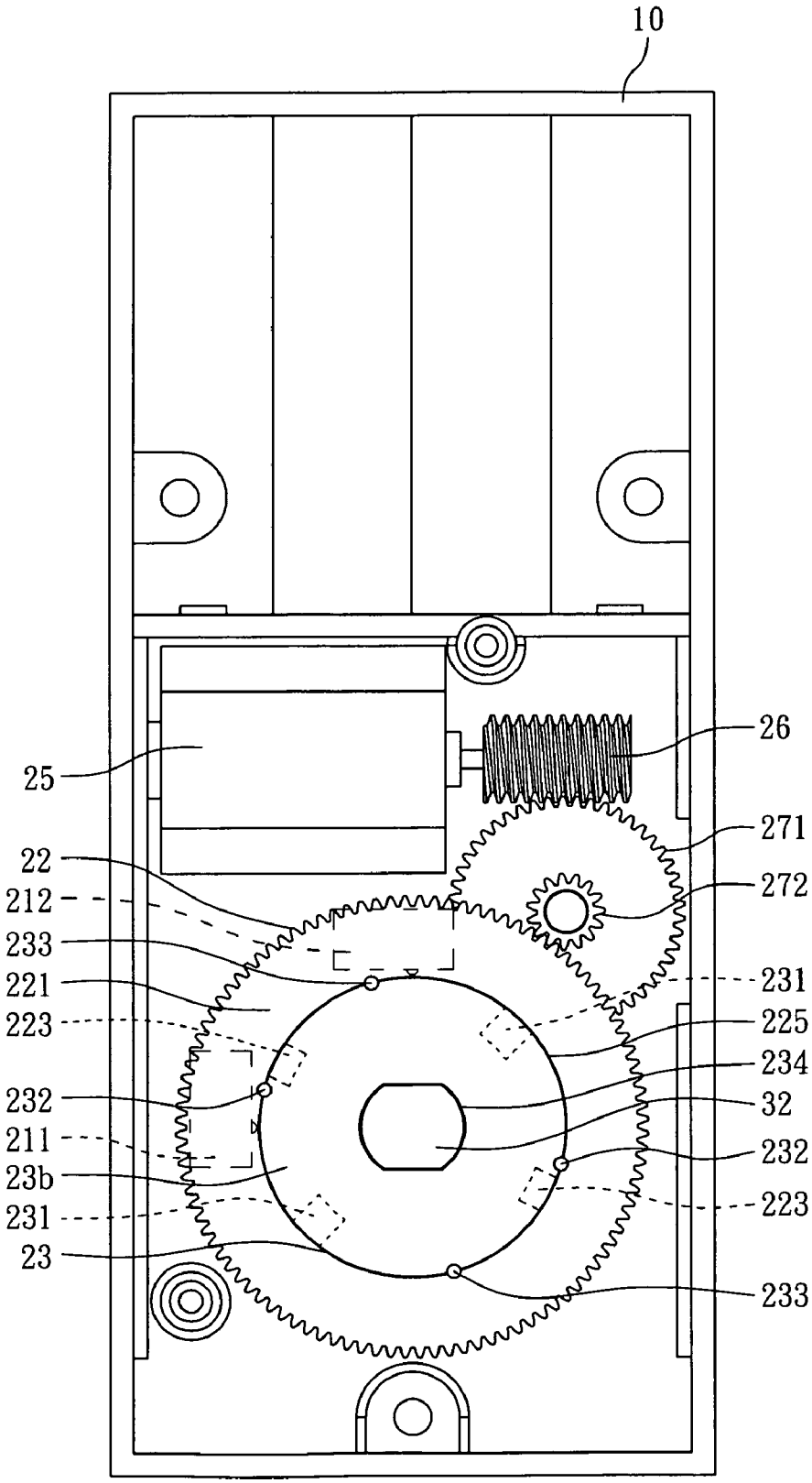
FIG. 5A to FIG. 5C is an action view of locking the electro-mechanical lock structure with manual control manner.
Figure 5B:
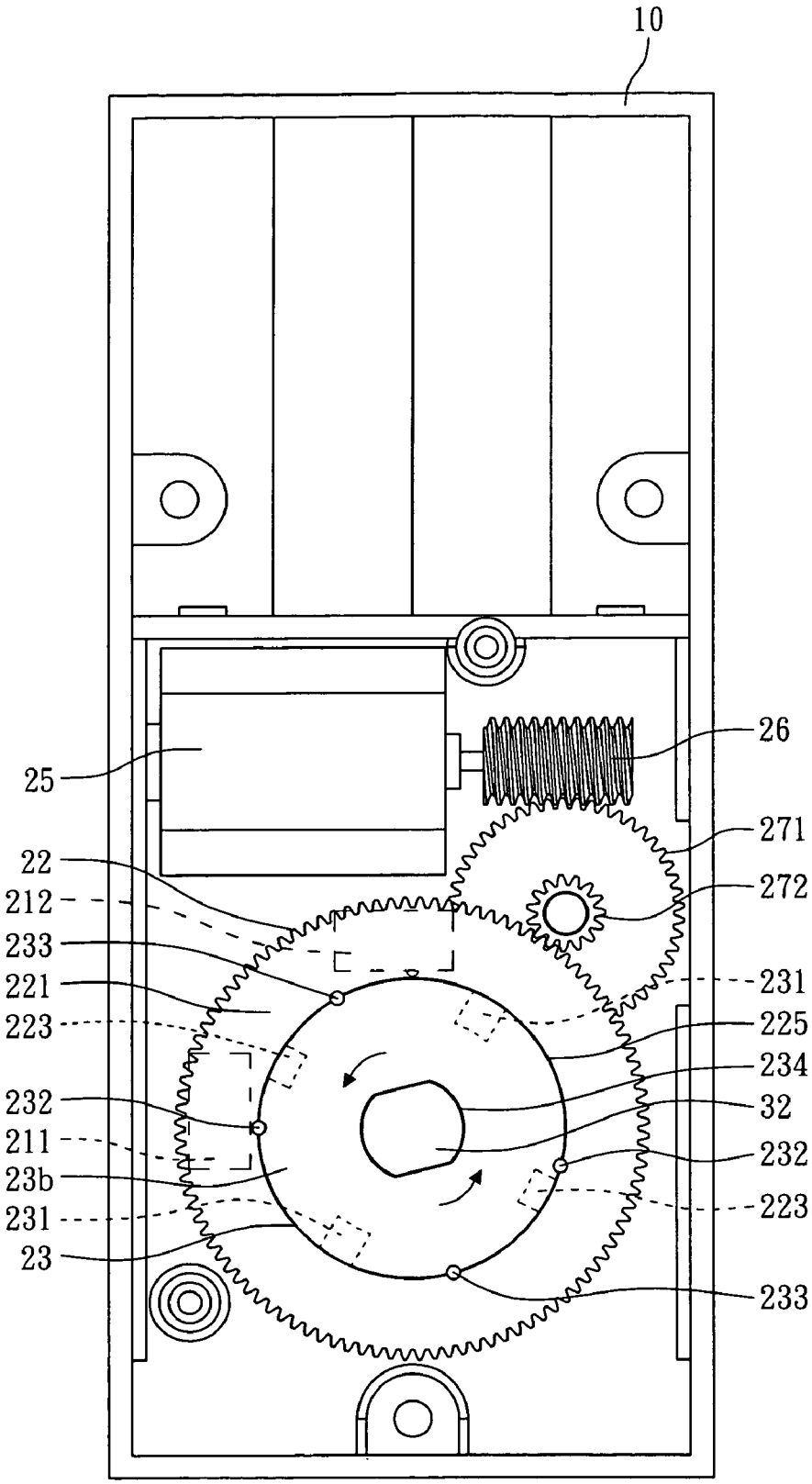
Figure 5C:
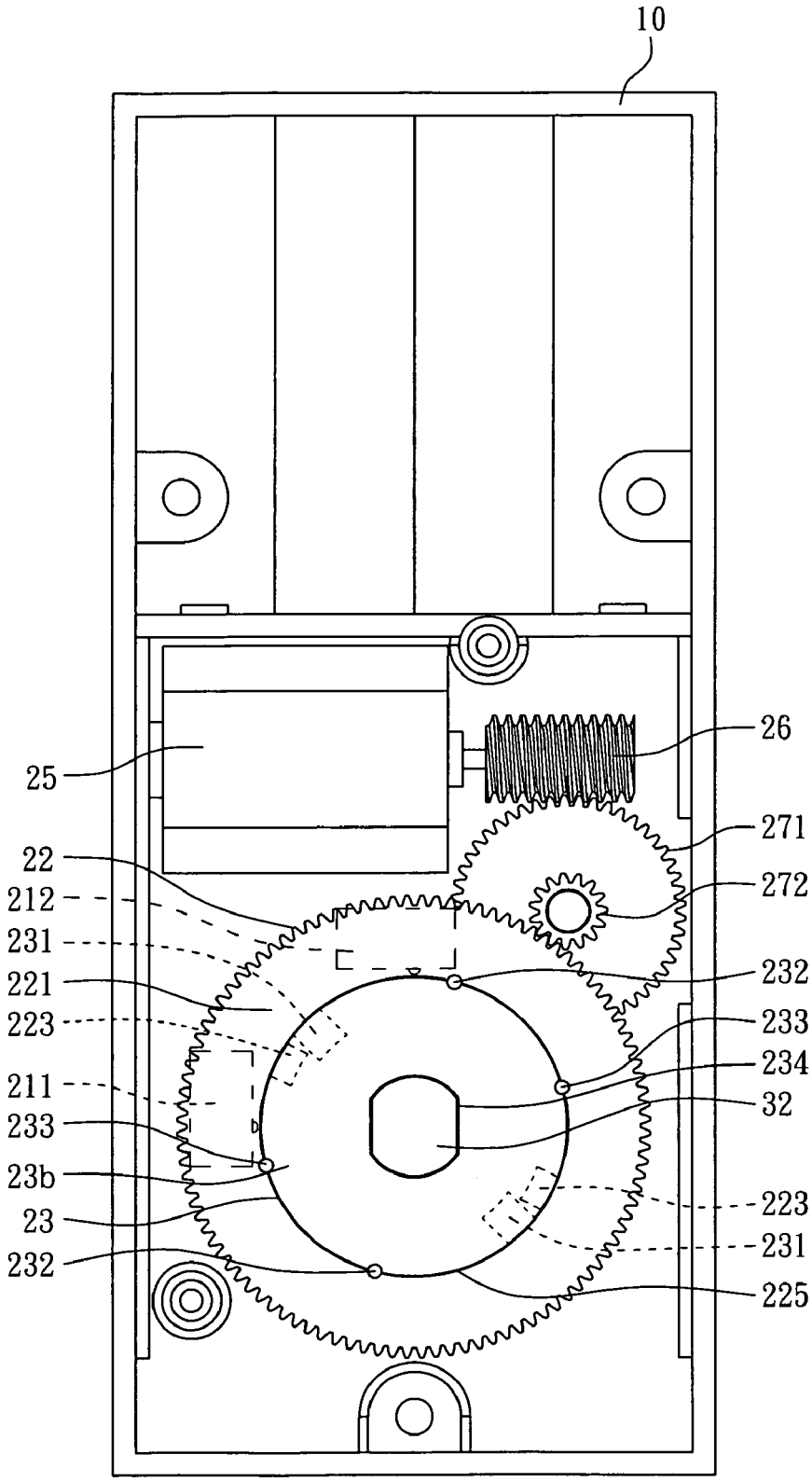

FIG. 5A to FIG. 5C shows an action about that the electro-mechanical lock structure performs locking action with manual control manner. First, FIG. 5A shows the elements of the electro-mechanical lock structure in unlocking position in which the first projection 232 of the rotation member 23 corresponds to the first control switch 211 and the second projection 233 corresponds to the second control switch 212. In this embodiment, if the electro-mechanical lock structure performs locking operation, then it turns counterclockwise and assigns the first control switch 211 to be the locking switch, otherwise in another embodiment, it may also be designed to turn clockwise and assign the second control switch 212 to be the locking switch. Next, with reference to FIG. 5B, while turning the manual control member 30 counterclockwise, the spindle 32 drives the rotation member 23 rotating and then the first projection 232 of the rotation member 23 actuates the first control switch 211. Due to the connection between the manual control member 30 and a cylinder lock (not shown in the drawings) in this embodiment, the manual control member 30 is designed to have a maximum turning angle 90°. Then with reference to FIG. 5C, while the manual control member 30 is turned 90° counterclockwise, the second projection 233 of the rotation member 23 actuates the first control switch 211 again to switch the electro-mechanical lock structure to locking position. Similarly, it merely needs to turn the manual control member 30 90° clockwise for switching the electro-mechanical lock structure to unlocking position with manual control manner.

Figure 6A:
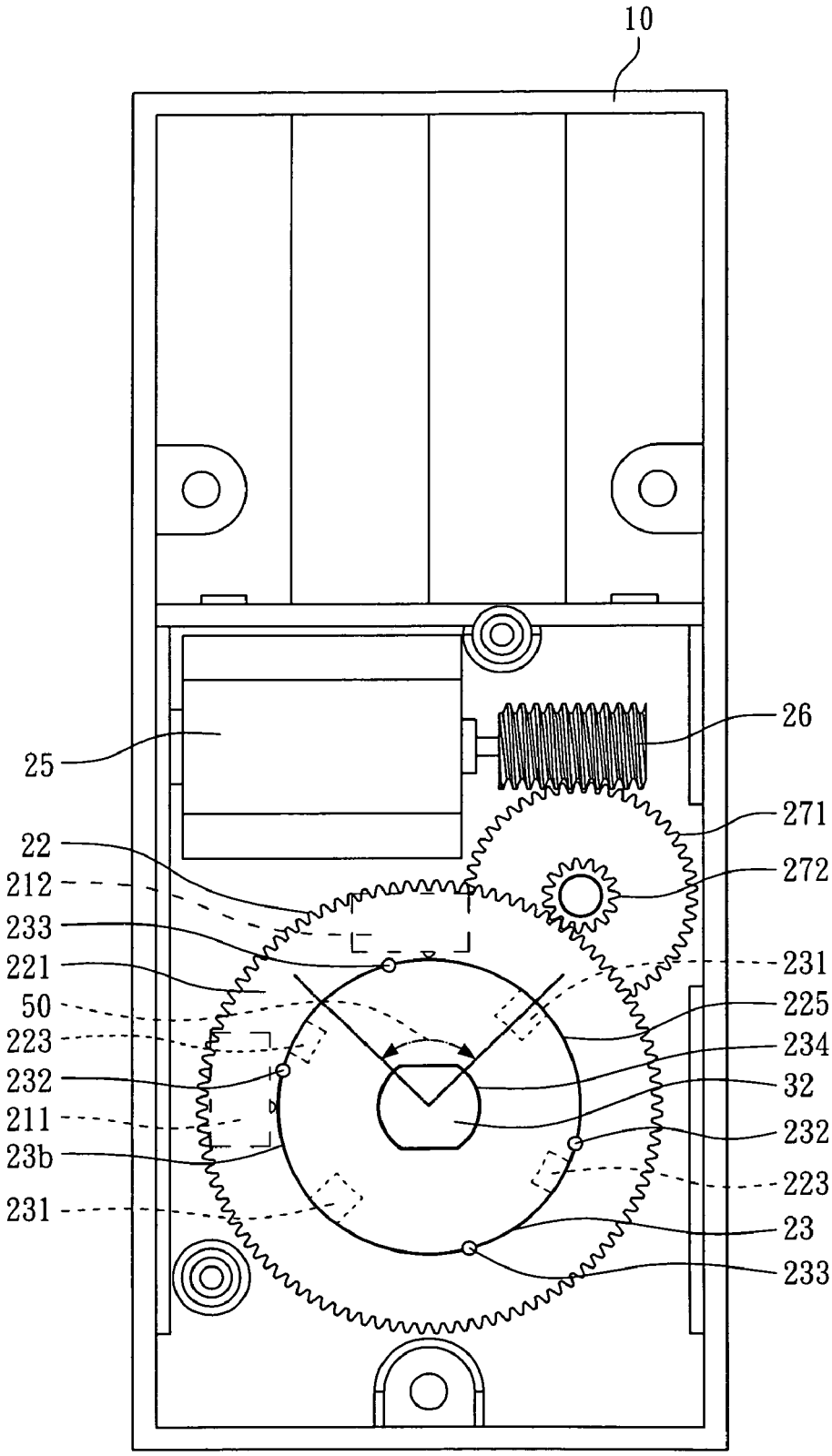
FIG. 6A to FIG. 6E is an action view of locking the electro-mechanical lock structure with electric control manner.
Figure 6B:
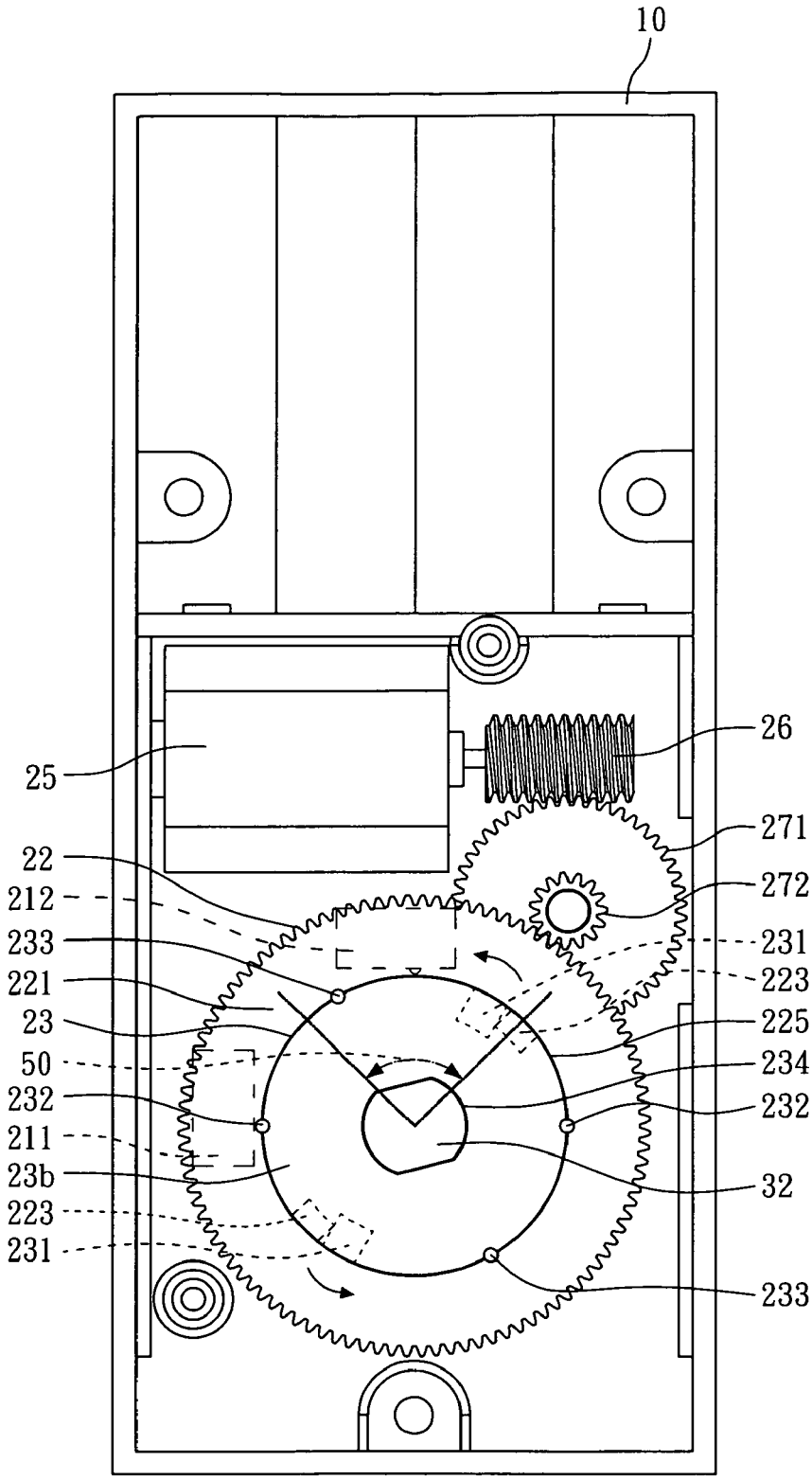
Figure 6C:
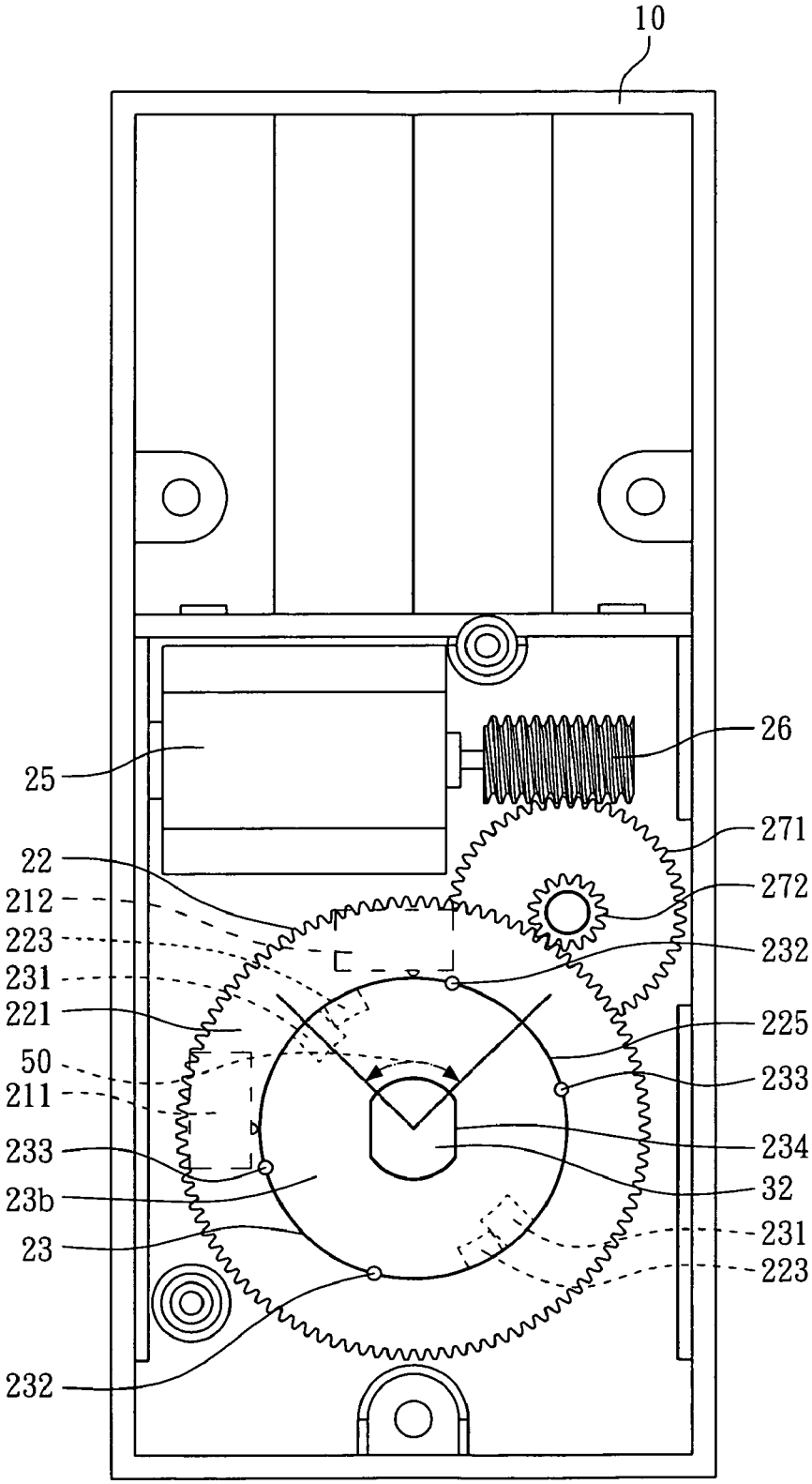
Figure 6D:
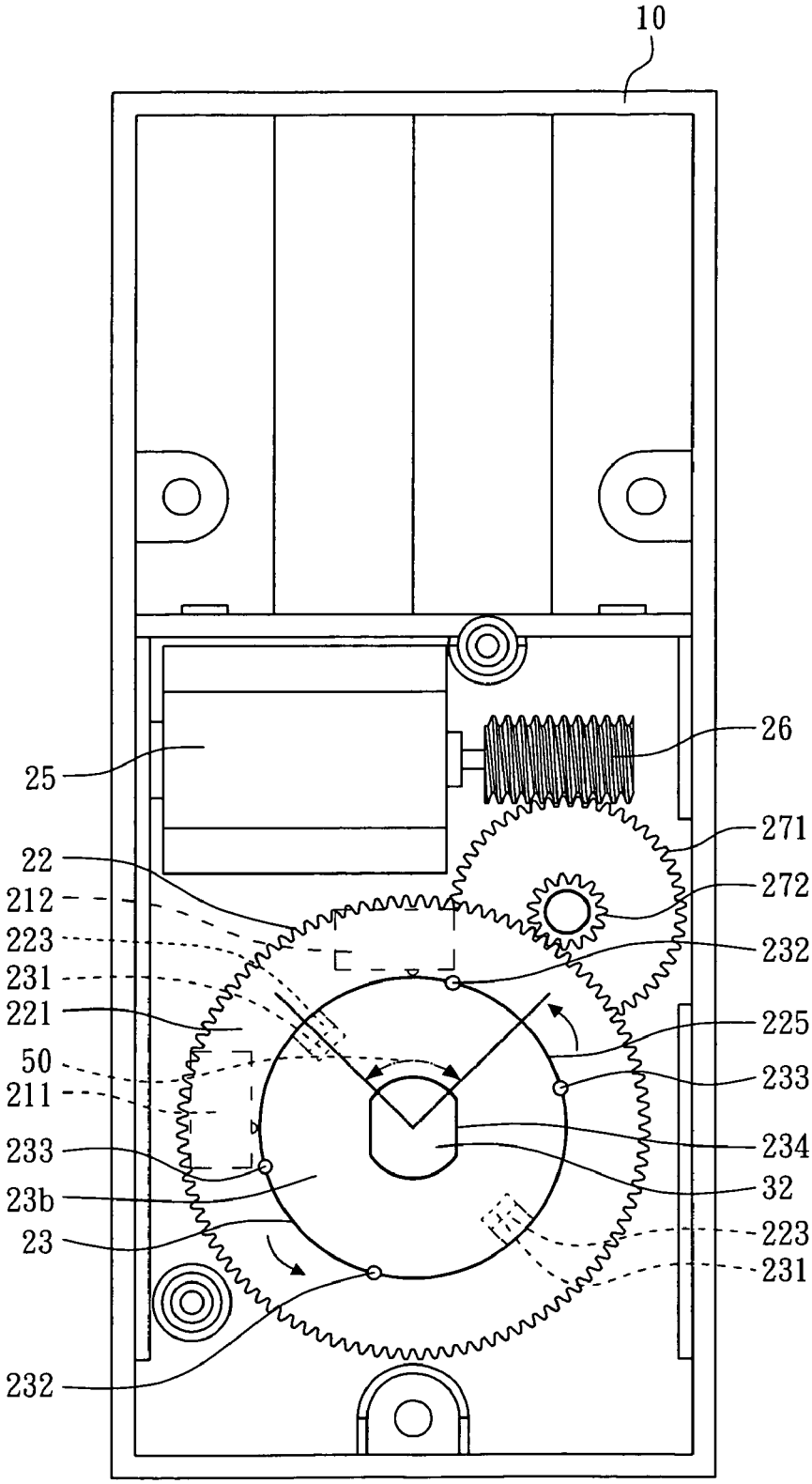
Figure 6E:
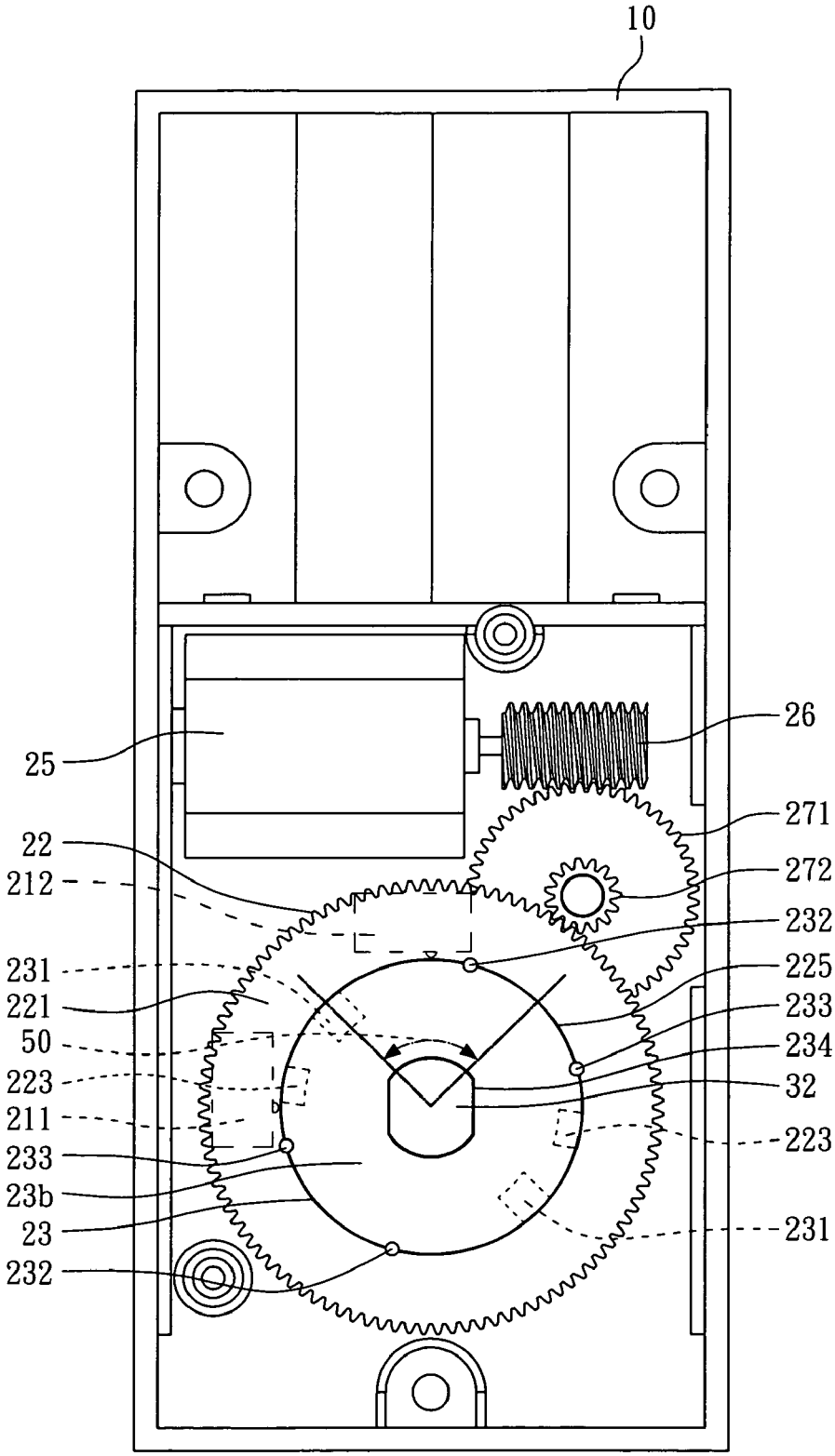
Figure 7A:
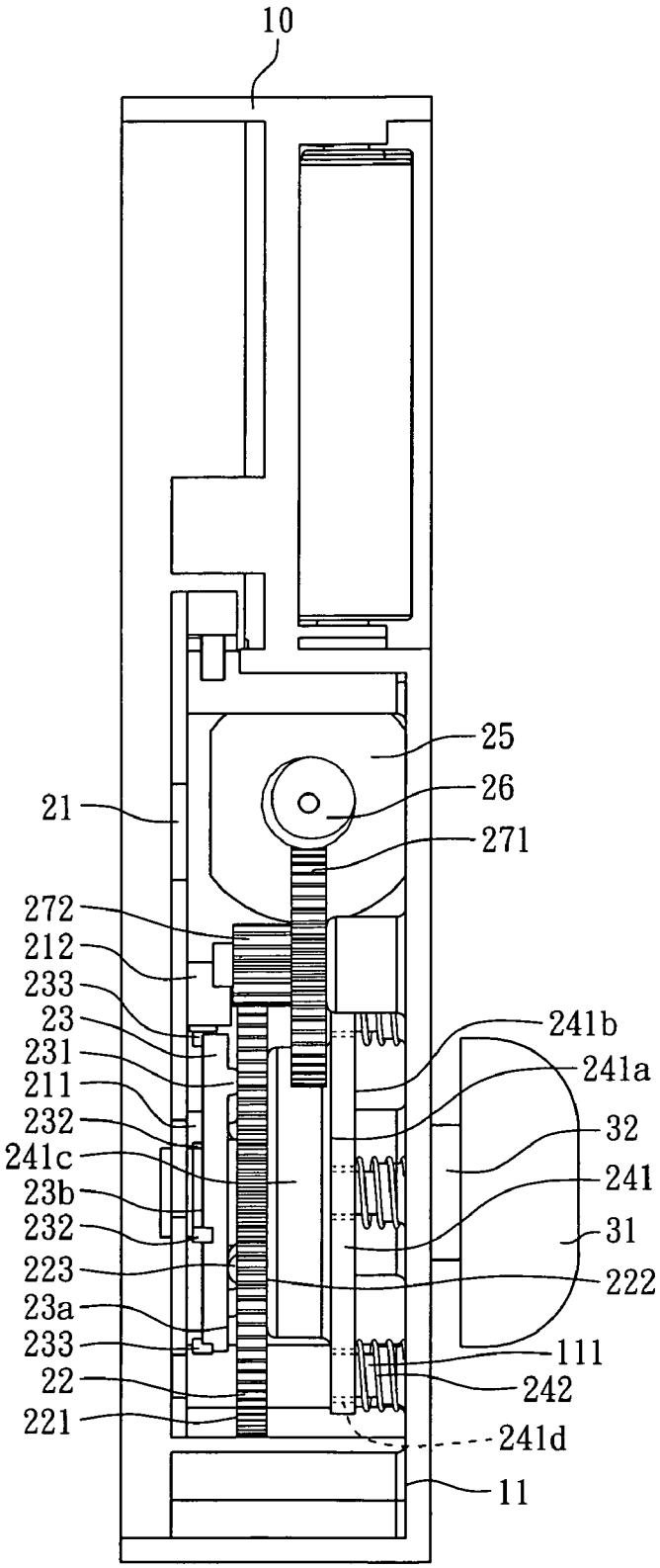
FIG. 7A to FIG. 7E is a portion of action cutaway view of locking the electro-mechanical lock structure with electric control manner.
Figure 7B:
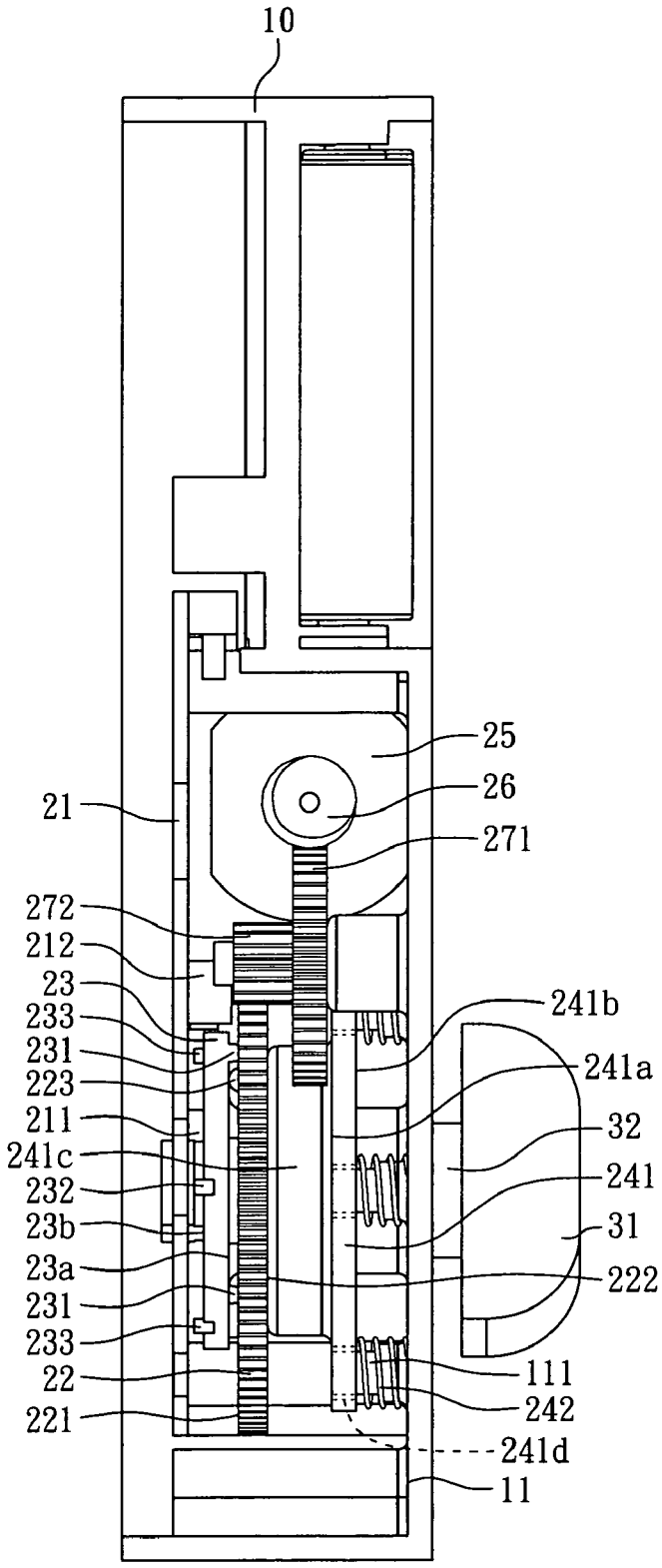
Figure 7C:
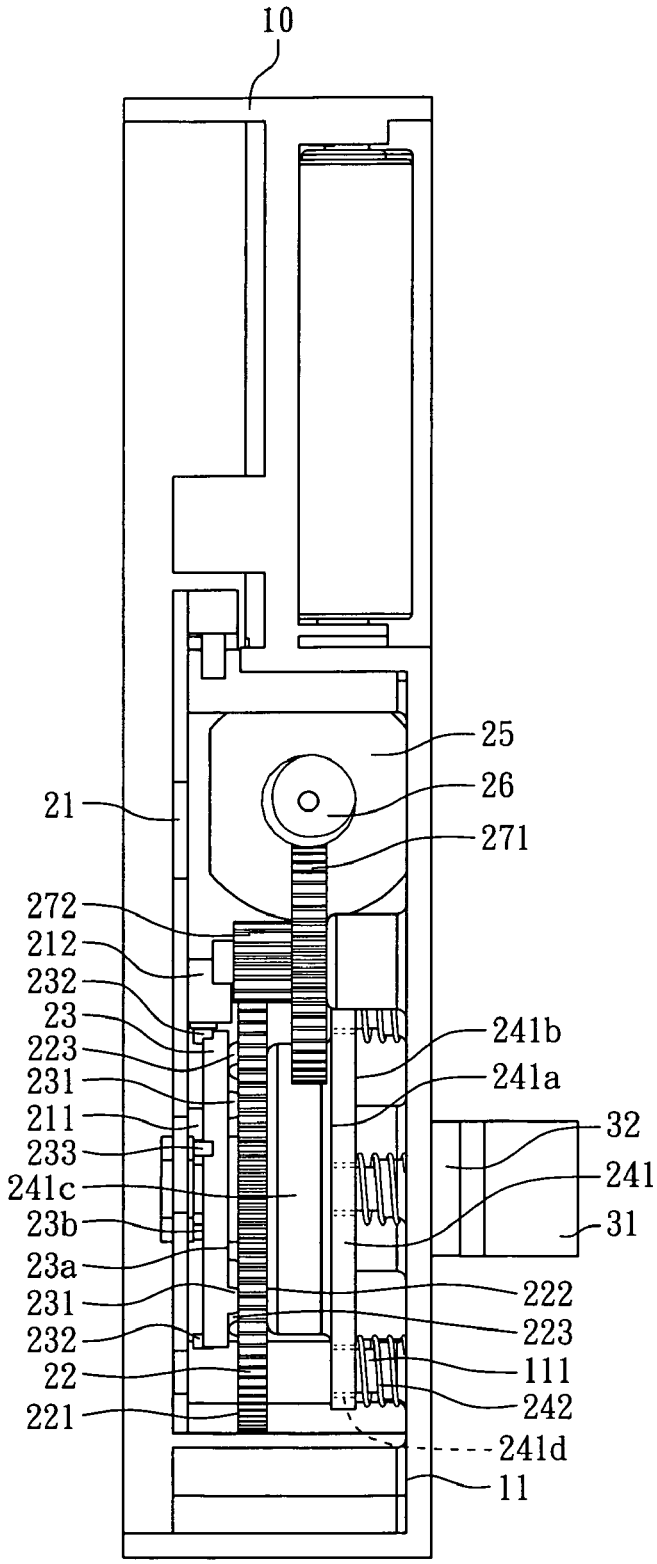
Figure 7D:
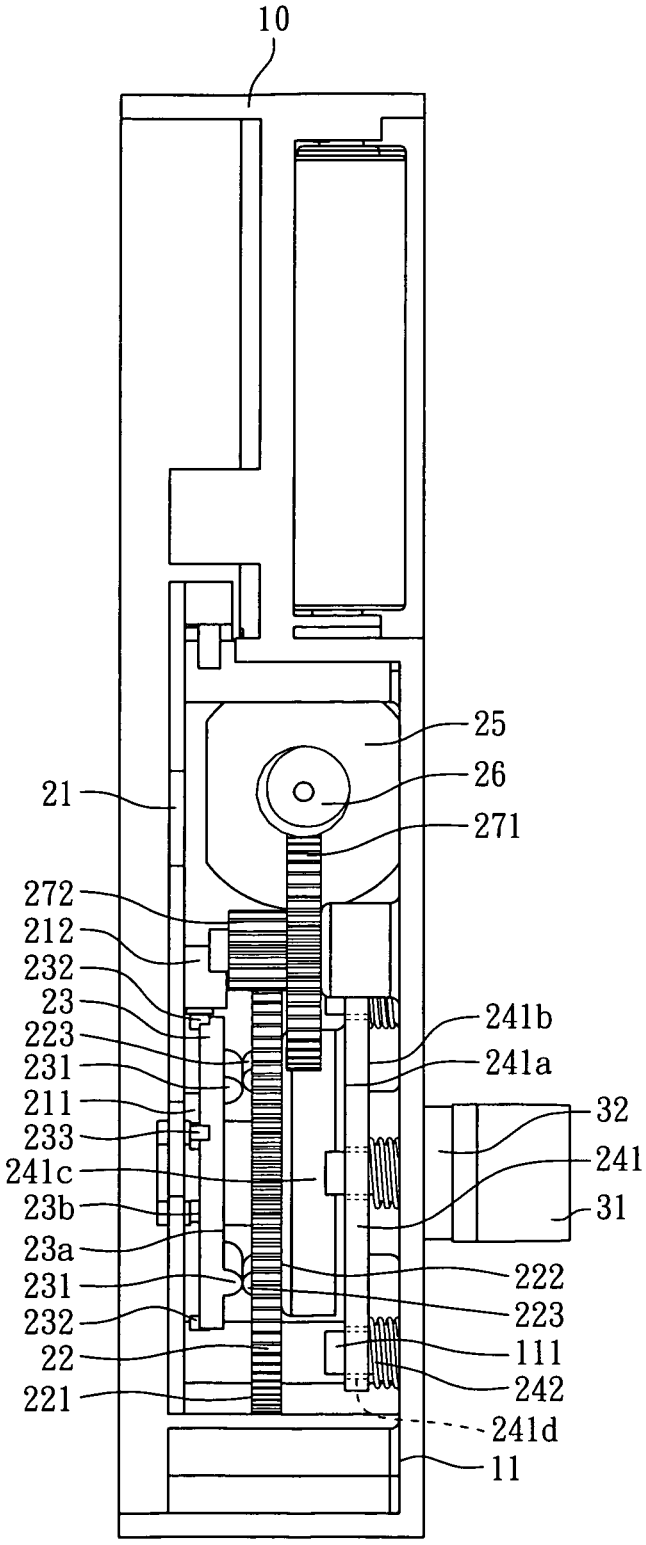
Figure 7E:
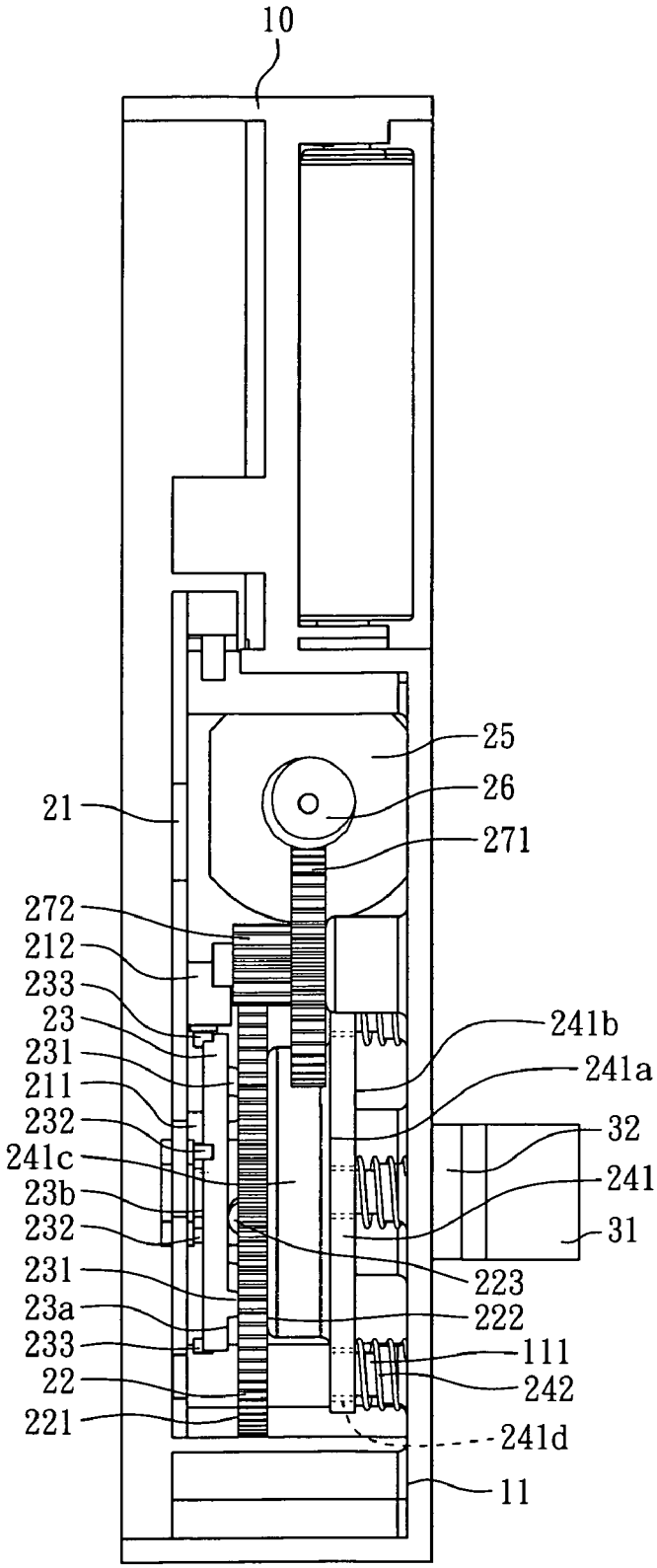

FIG. 6A to FIG. 6E and FIG. 7A to FIG. 7E shows an action about that the electro-mechanical lock structure performs locking operation with electric control manner. First FIG. 6A and FIG. 7A show the elements of the electro-mechanical lock structure in unlocking position in which the first projection 232 of the rotation member 23 corresponds to the first control switch 211 and the second projection 233 corresponds to the second control switch 212. The protrusion 231 of the rotation member 23 defines a rotation range 50 and which is preferably limited within a 90° fan-shaped area. While the electro-mechanical lock structure is in unlocking position, the pushing block 223 of the clutch gear 22 is located exterior to the rotation range 50 thereby preventing the mutual interference between the electric and manual control operations. In addition, in case of performing locking operation in this embodiment, the electro-mechanical lock structure turns counterclockwise and assigns the first control switch 211 to be the locking switch, otherwise in another embodiment, it may also be designed to turn clockwise and merely assign the second control switch 212 to be the locking switch. Next, with reference to FIG. 6B and FIG. 7B, while user utilizes a remote controller or a push button assembly (both are not shown in the drawings) to actuate the electro-mechanical lock structure, the motor 25 starts to drive the worm gear 26 rotating and further drives the double-layer gear 27 and the clutch gear 22 to rotate, that makes the pushing block 223 of the clutch gear 22 first contact and push the protrusion 231 of the rotation member 23 as to rotate the rotation member 23. Meantime, the first projection 232 of the rotation member 23 first actuates the first control switch 211. Due to the connection between the manual control member 30 and a cylinder lock (not shown in the drawings) in this embodiment, the manual control member 30 is designed to have a maximum turning angle 90°, similarly, the rotation member 23 which couples to the spindle 32 of the manual control member 30 still has a maximum turning angle 90°. Then with reference to FIG. 6C and FIG. 7C, while the rotation member 23 is turned 90° counterclockwise, the second projection 233 actuates the first control switch 211 again to switch the electro-mechanical lock structure to locking position. In this case, in order to allow the pushing block 223 of the clutch gear 22 to be located exterior to the rotation range 50, after performing locking operation, the motor 25 remains driving the clutch gear 22 to rotate after the second projection 233 actuates the first control switch 211 until the pushing block 223 of the clutch gear 22 crosses the protrusion 231 of the rotation member 23. With reference to FIG. 6D and FIG. 7D, because the rotation member 23 stops rotating after locked, the pushing block 223 of the clutch gear 22 is obstructed by the protrusion 231 while crossing the protrusion 231 of the rotation member 23. Meantime, the torque for driving the clutch gear 22 rotating is transformed to a pushing force in axial direction to enforce the clutch gear 22 moving toward the base 11 and push the movable plate 241 of the movable assembly 24, which allows the movable plate 241 moving to compress the elastic member 242. In this embodiment, since the movable assembly 24 moves toward the base 11 while compressed, the pushing block 223 of the clutch gear 22 can cross the protrusion 231 of the rotation member 23 smoothly without obstructed by the movable assembly 24, in which the pushing block and the protrusion 231 have an arc-shaped contact surface. With reference to FIG. 6E and FIG. 7E, after the pushing block 223 of the clutch gear 22 crosses the protrusion 231 of the rotation member 23, the elastic member 242 pushes the movable plate 241 for restoring the movable plate 241 and the clutch gear 22, the motor 25 stops running immediately, the pushing block 223 is located exterior to the rotation range 50 at this time. While unlocking the electro-mechanical lock structure with manual control manner, an action of the manual control member 30 won't be interfered by the pushing block 241 of the clutch gear 22. Similarly, while switching the electro-mechanical lock structure to unlocking position with electric control manner, the motor 25 drives the clutch gear 22 rotating clockwise and further drives the rotation member 23 rotating clockwise, and then the first and second projections 232, 233 of the rotation member 23 actuate the first control switch 211 respectively thereby switching to unlocking position. Therefore, due to the connection having excellent coordination among the clutch gear 22, the rotation member 23 and the movable assembly 24 in accordance with this invention, operating smooth for electric and manual control can be enhanced widely.

Figure 8:
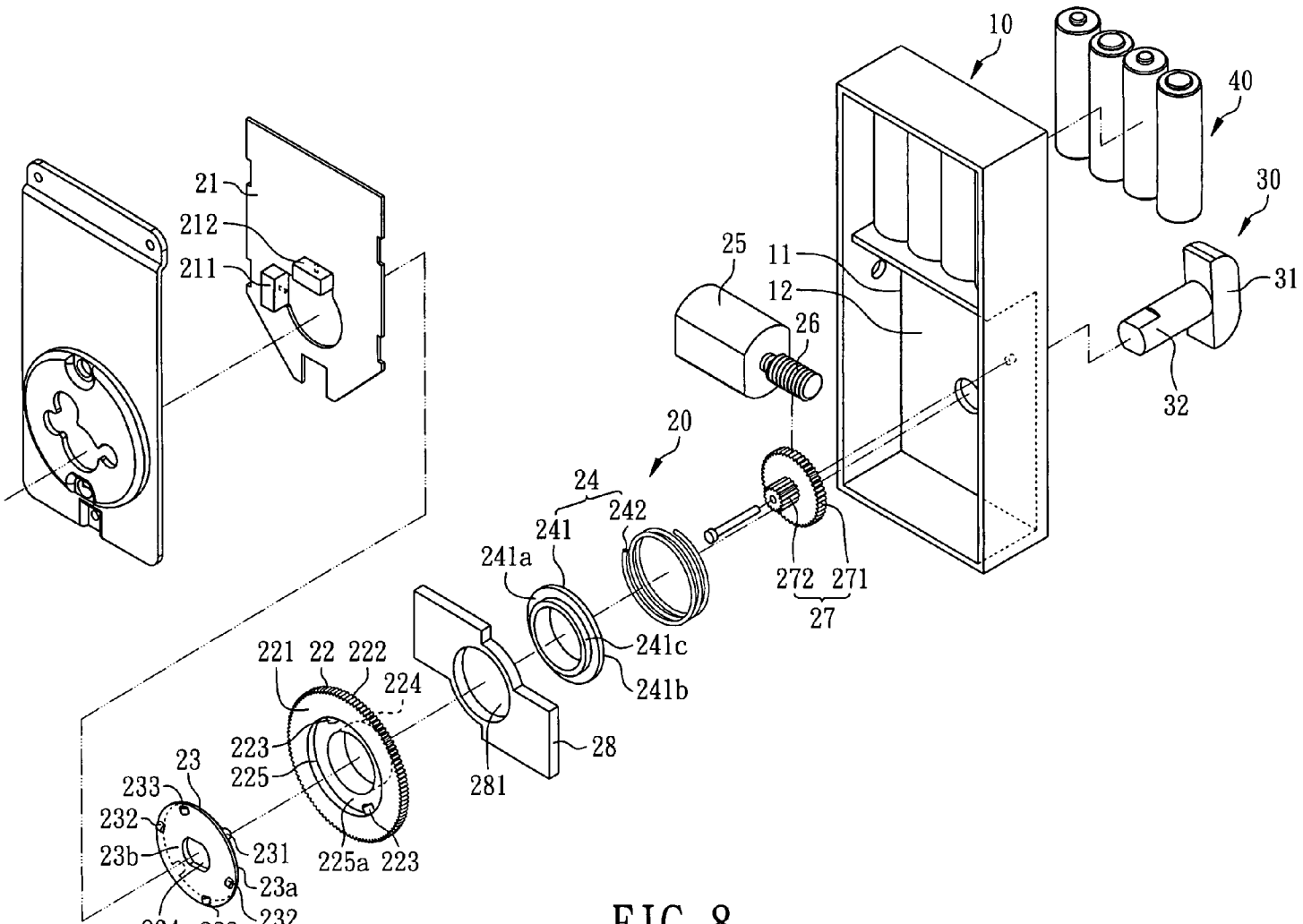
FIG. 8 is a perspective exploded view of an electro-mechanical lock structure in accordance with the second preferred embodiment of this invention.
Figure 9:
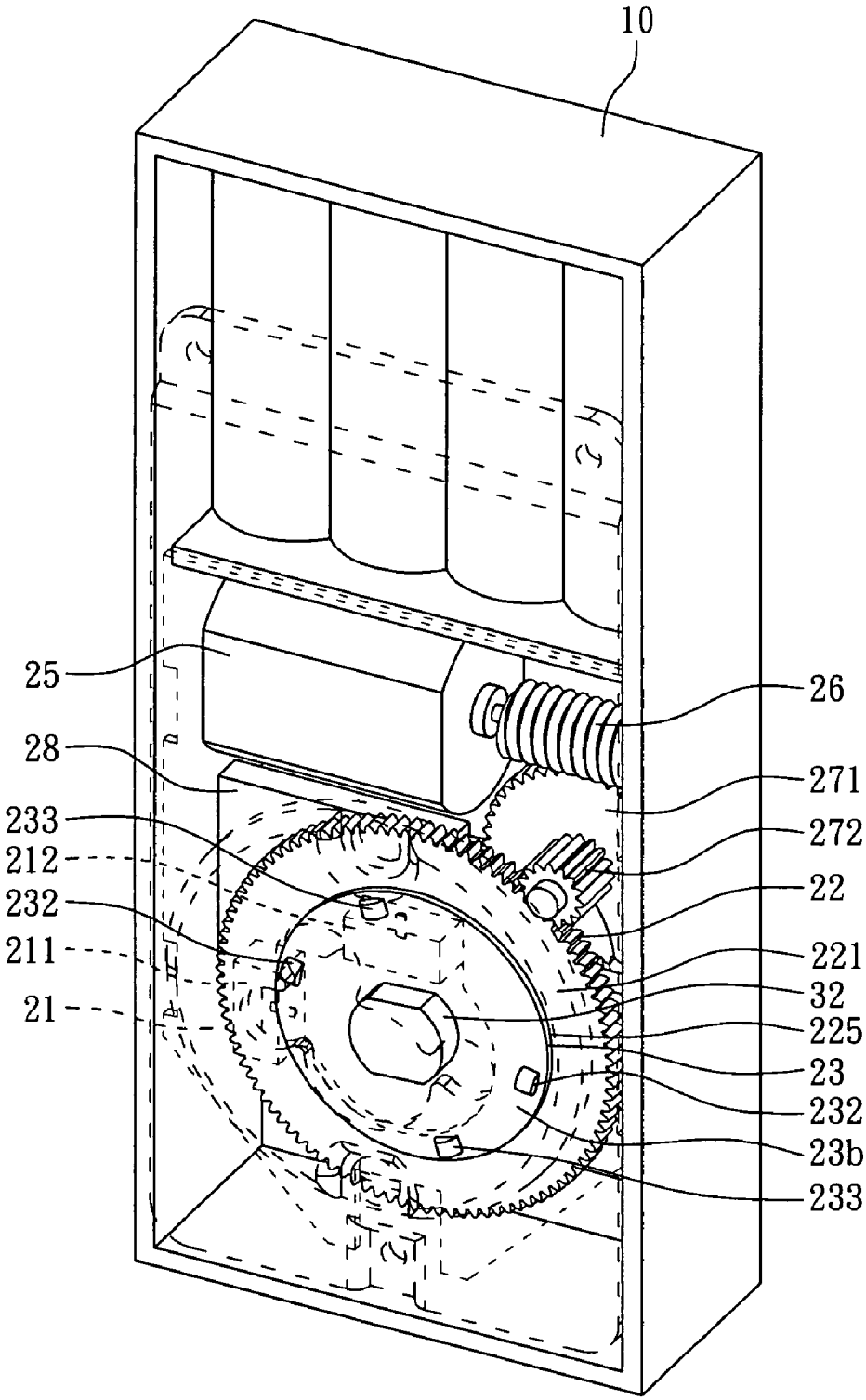
FIG. 9 is a perspective assembly view of the electro-mechanical lock structure in accordance with the second preferred embodiment of this invention.
Figure 10:
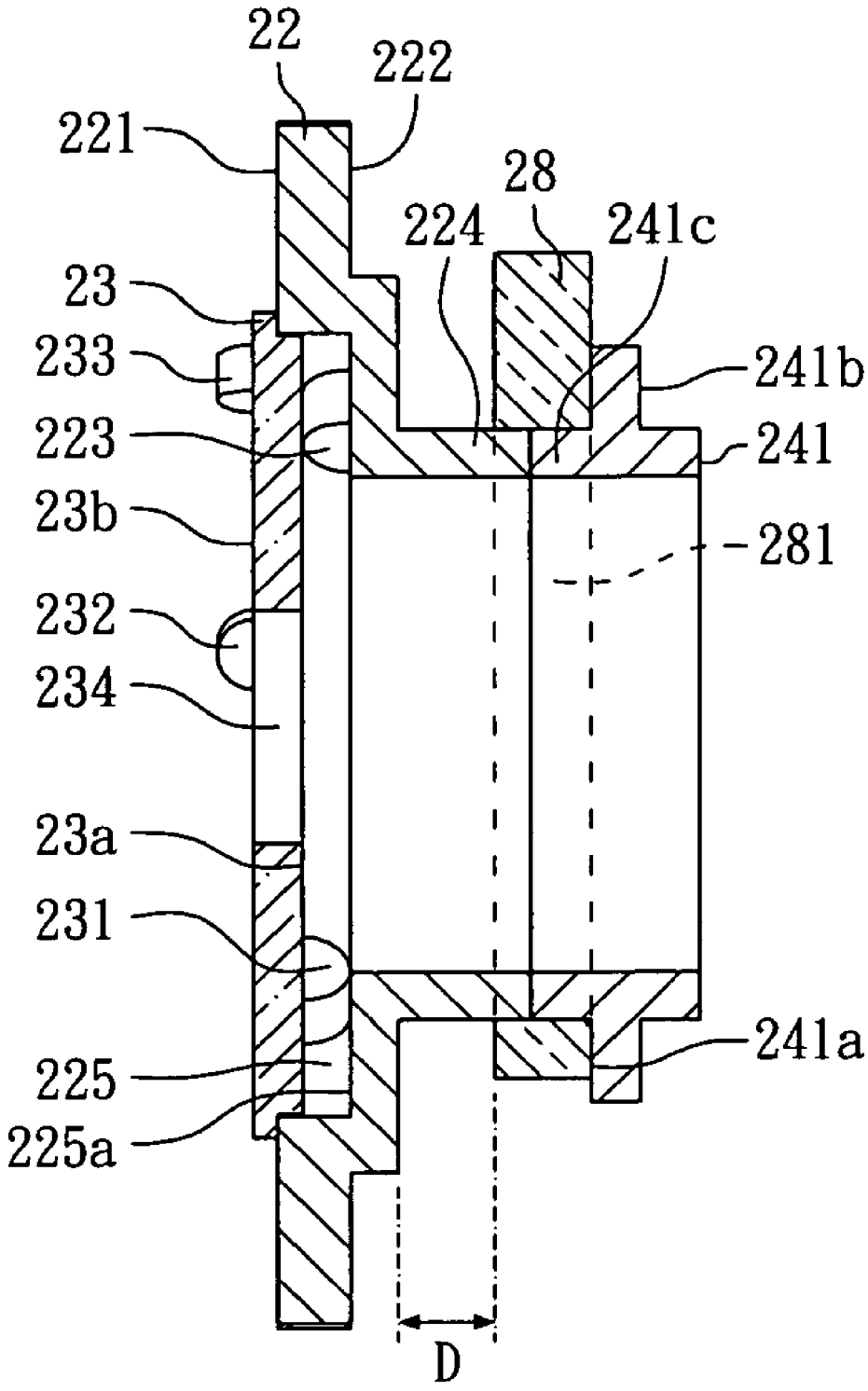
FIG. 10 is an assembly view of rotation member, clutch gear and movable plate in accordance with the second preferred embodiment of this invention.
Figure 11:
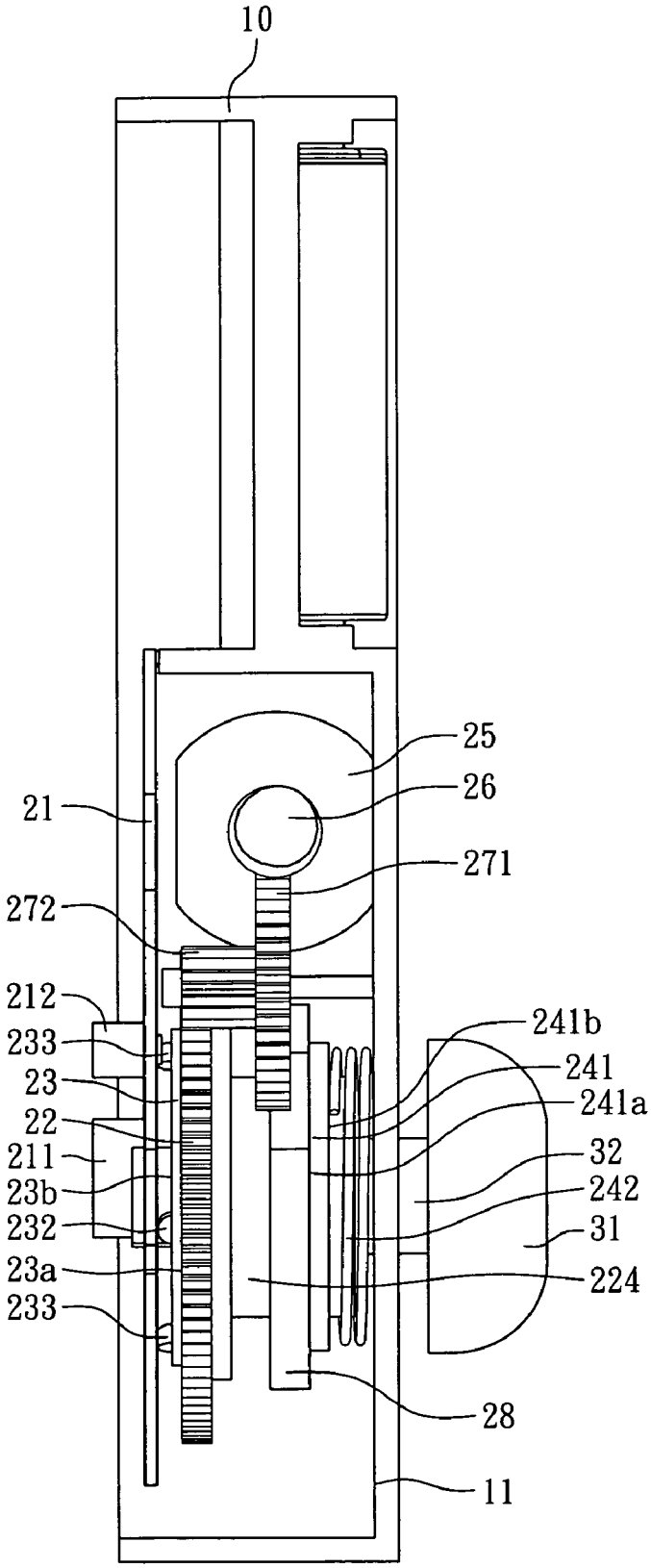
FIG. 11 is a portion of cutaway view of the electro-mechanical lock structure in accordance with the second preferred embodiment of this invention.

FIG. 8 and FIG. 9 show the second preferred embodiment of this invention, whose structure is basically the same as that of the first preferred embodiment mentioned above except that the electric control mechanism 20 further comprises a fixed plate 28. The fixed plate 28 is disposed between the clutch gear 22 and the movable plate 241 having an axis hole 281. With reference to FIG. 10 and FIG. 11, the tube portion 241*c* of the movable plate 241 is inserted into the axis hole 281 of the fixed plate 28 and contacts against the projecting portion 224 of the clutch gear 22. Besides, the fixed plate 28 remains fixed during locking/unlocking process, so that there is an interval D is disposed between the second side 222 of the clutch gear 22 and the fixed plate 28 in this embodiment in order to allow the clutch gear 22 not to be obstructed while moving. The interval D may provide the clutch gear 22 a space for moving without obstructed by the fixed plate 28. Furthermore, this embodiment has basically the same locking action with manual and electric control manners as the first preferred embodiment does.

Figure 12:
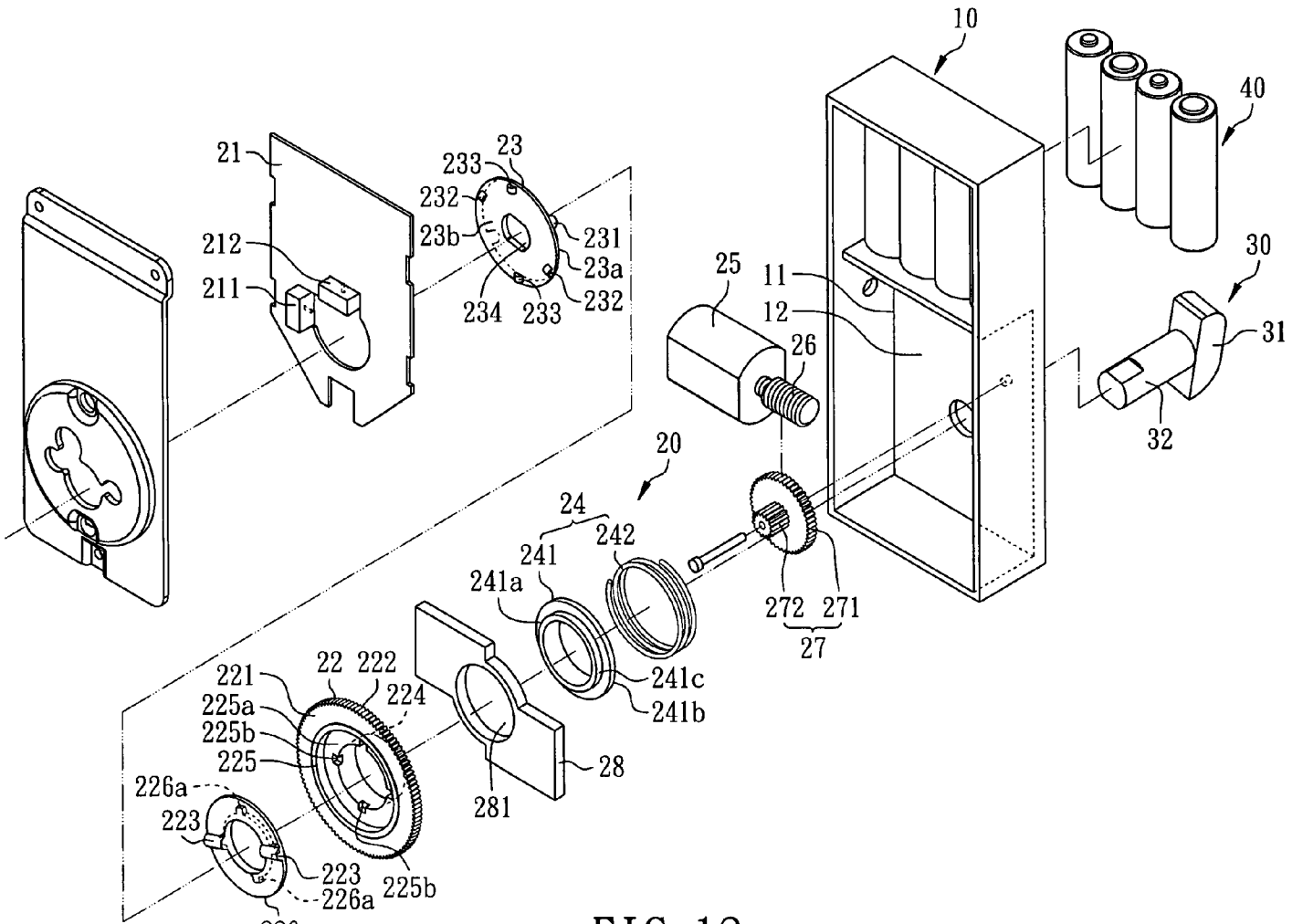
FIG. 12 is a perspective exploded view of an electro-mechanical lock structure in accordance with the third preferred embodiment of this invention.
Figure 13:
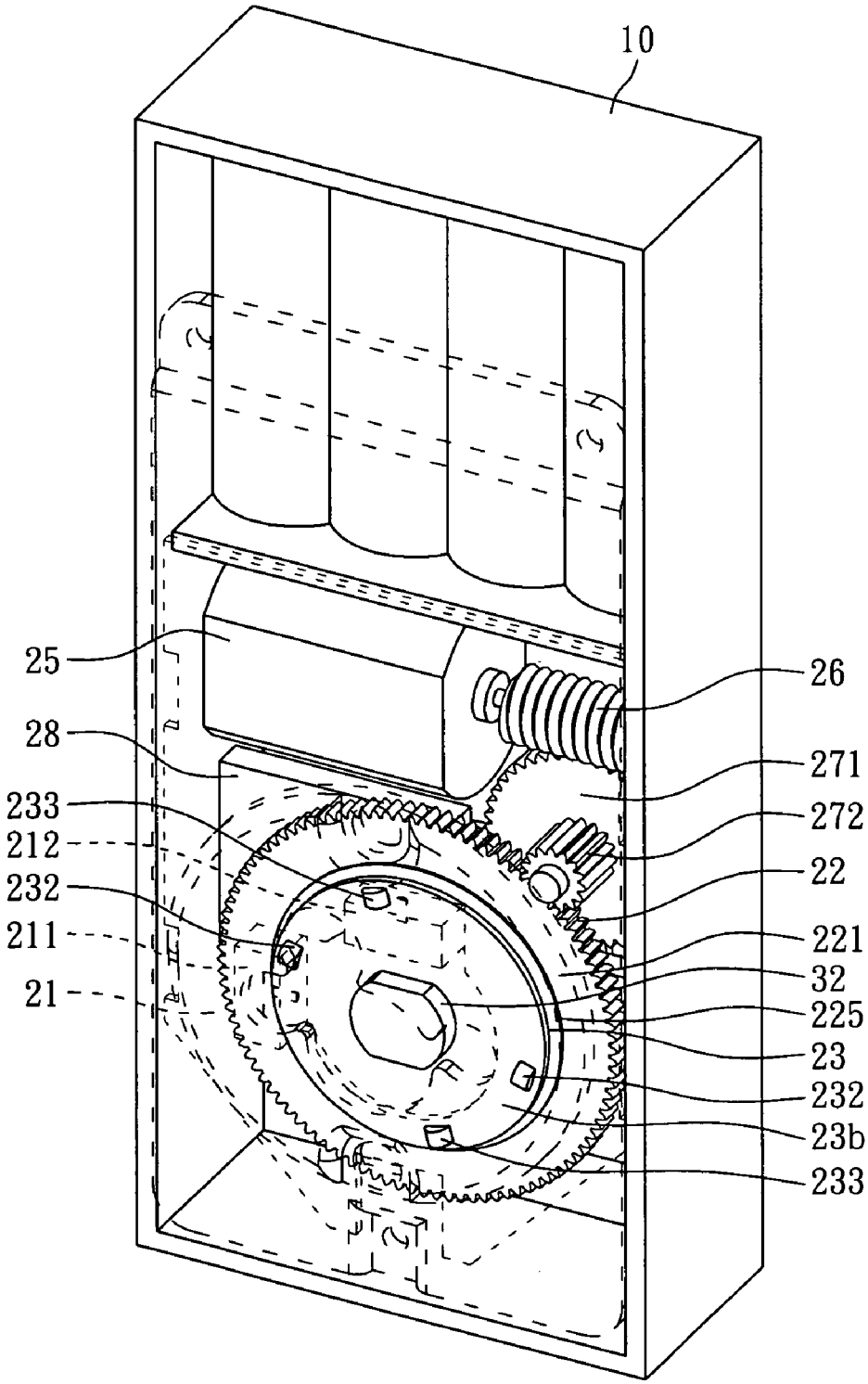
FIG. 13 is a perspective assembly view of the electro-mechanical lock structure in accordance with the third preferred embodiment of this invention.
Figure 14:
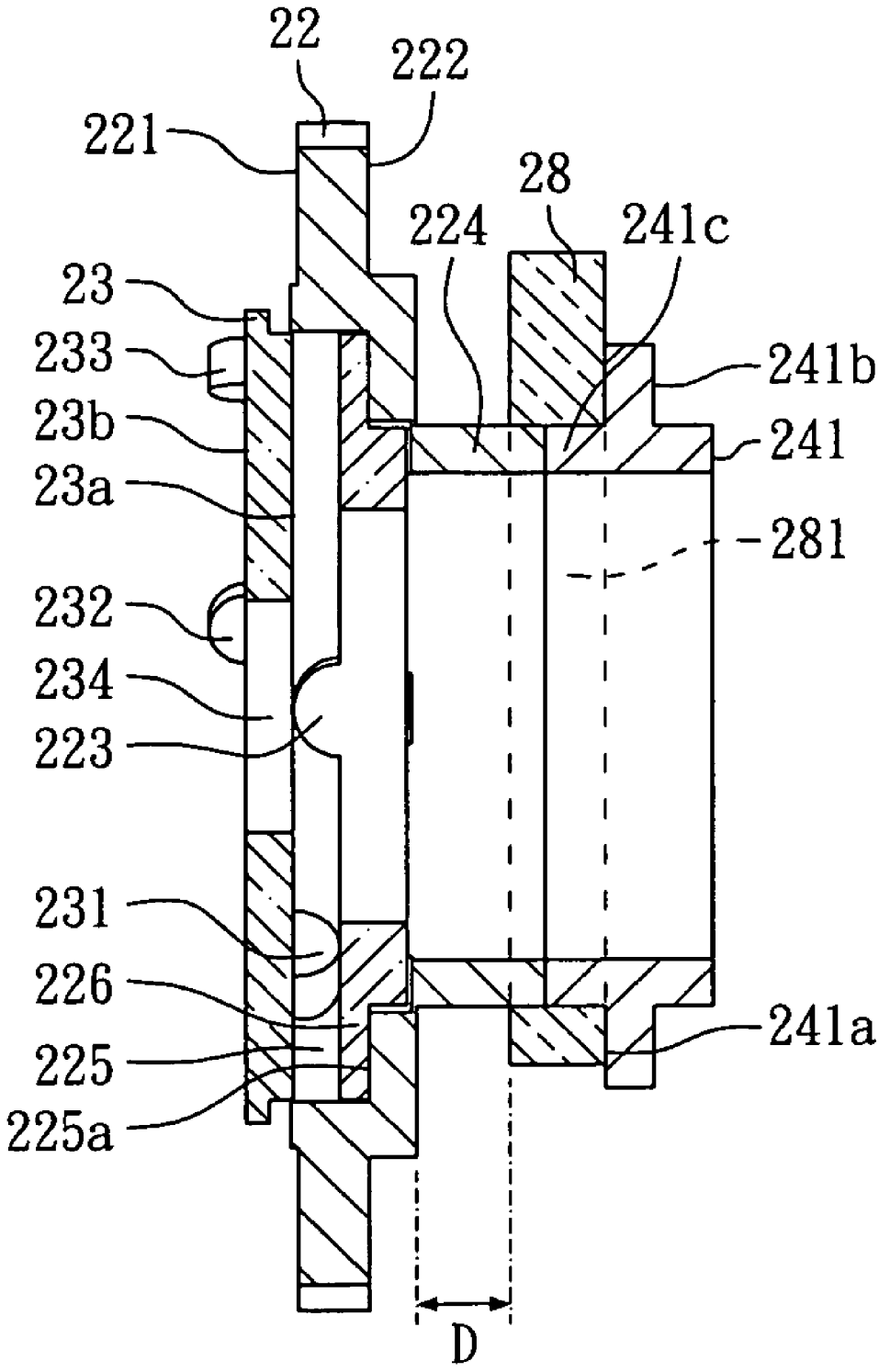
FIG. 14 is an assembly view of rotation member, clutch gear and movable plate in accordance with the third preferred embodiment of this invention.
Figure 15:
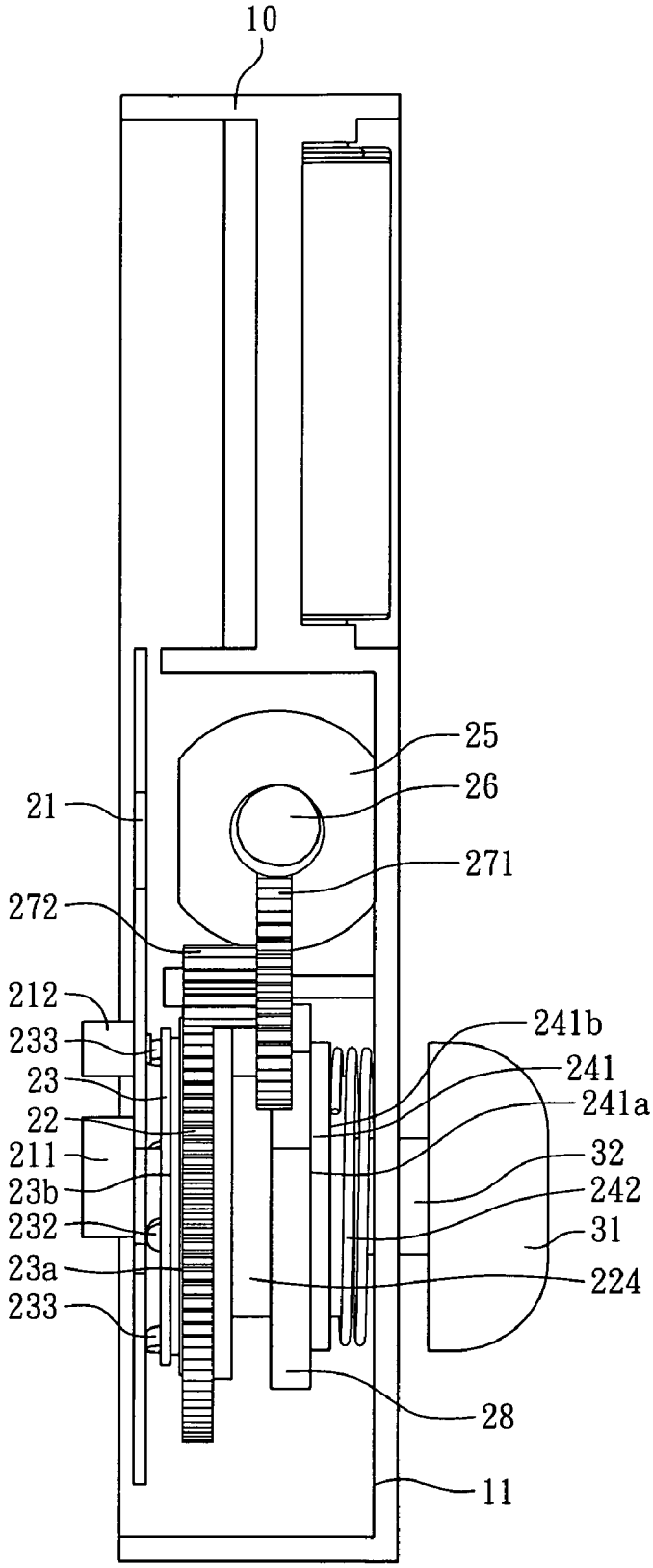
FIG. 15 is a portion of cutaway view of the electro-mechanical lock structure in accordance with the third preferred embodiment of this invention.

In addition, FIG. 12 and FIG. 13 show the third preferred embodiment of this invention, whose structure is basically the same as that of the second preferred embodiment mentioned above except that the clutch gear 22 further has a coupling plate 226. The coupling plate 226 is disposed within the cavity 225 and forms the pushing block 223 thereon. With reference to FIG. 14 and FIG. 15, to couple the coupling plate 226 to the clutch gear 22 stably in this embodiment is provided by that the cavity 225 has at least one slot 225*b* recessed from the bottom surface 225*a* and the coupling plate 226 has at least one bump 226*a* disposed opposite to the pushing block 223, the bump 226*a* is capable of engaging with the slot 225*b* so that the coupling plate 226 can be stably coupled to the clutch gear 22. Furthermore, this embodiment also has basically the same locking action with manual and electric control manners as the first preferred embodiment does.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. An electro-mechanical lock structure comprising:

a casing having a base and an accommodating space;

an electric control mechanism disposed within the accommodating space of the casing and comprising a clutch gear, a movable assembly, a rotation member and a motor able to drive the clutch gear, wherein the clutch gear has a first side facing the rotation member, a second side opposite to the first side and at least one pushing block disposed at the first side, the movable assembly contacts against the second side of the clutch gear, the rotation member has at least one protrusion that corresponds to the pushing block and able to be pushed to move by the pushing block; and a manual control member coupled to the rotation member of the electric control mechanism, wherein the movable assembly comprises a movable plate and at least one elastic member, the movable plate has a first sidepiece and a second sidepiece opposite to the first sidepiece, the first sidepiece of the movable plate contacts against the second side of the clutch gear, the elastic member contacts against the second sidepiece of the movable plate.

2. The electro-mechanical lock structure in accordance with claim 1, wherein the first side of the clutch gear has a cavity formed thereon, the pushing block is disposed within the cavity.

3. The electro-mechanical lock structure in accordance with claim 2, wherein the clutch gear has a coupling plate disposed within the cavity, the pushing block is formed on the coupling plate.

4. The electro-mechanical lock structure in accordance with claim 3, wherein the cavity has a bottom surface and at least one slot recessed from the bottom surface, the coupling plate has at least one bump that disposes opposite to the pushing block and engages with the slot.

5. The electro-mechanical lock structure in accordance with claim 1, wherein one end of the elastic member contacts against the base of the casing.

6. The electro-mechanical lock structure in accordance with claim 1, wherein the movable plate has a tube portion protruding from the first sidepiece, the clutch gear has a projecting portion protruding from the second side, the tube portion of the movable plate contacts against the projecting portion of the clutch gear.

7. The electro-mechanical lock structure in accordance with claim 6, wherein the electric control mechanism further comprises a fixed plate disposed between the clutch gear and the movable plate, the fixed plate has an axis hole and the tube portion of the movable plate is inserted into the axis hole of the fixed plate.

8. The electro-mechanical lock structure in accordance with claim 1, wherein the rotation member has a first surface facing the clutch gear and a second surface opposite to the first surface, the protrusion protrudes from the first surface.

9. The electro-mechanical lock structure in accordance with claim 8, wherein the electric control mechanism further comprises a first control switch and a second control switch, the rotation member has at least one first projection and second projection which protrude from the second surface, the first projection and the second projection correspond to the first control switch and the second control switch respectively.

10. The electro-mechanical lock structure in accordance with claim 1, wherein the manual control member has a knob and a spindle coupled to the knob, the spindle penetrates the base of the casing and one end of the spindle is coupled to the rotation member of the electric control mechanism.

* * * * *